US012491416B2

(12) United States Patent
Spackman et al.

(10) Patent No.: US 12,491,416 B2
(45) Date of Patent: Dec. 9, 2025

(54) IRON-TYPE GOLF CLUB HEAD WITH REAR OPENING AND INSERT

(71) Applicant: KARSTEN MANUFACTURING CORPORATION, Phoenix, AZ (US)

(72) Inventors: Clayson C. Spackman, Scottsdale, AZ (US); Matthew W. Simone, Phoenix, AZ (US); Cory S. Bacon, Scottsdale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 140 days.

(21) Appl. No.: 18/472,166

(22) Filed: Sep. 21, 2023

(65) Prior Publication Data

US 2024/0100403 A1 Mar. 28, 2024

Related U.S. Application Data

(60) Provisional application No. 63/376,746, filed on Sep. 22, 2022.

(51) Int. Cl.
*A63B 53/04* (2015.01)
*A63B 60/54* (2015.01)

(52) U.S. Cl.
CPC ..... *A63B 53/047* (2013.01); *A63B 60/54* (2015.10); *A63B 53/0412* (2020.08)

(58) Field of Classification Search
CPC ..... A63B 53/047; A63B 60/54
See application file for complete search history.

(56) References Cited

U.S. PATENT DOCUMENTS

| | | | |
|---|---|---|---|
| 6,592,469 | B2 | 7/2003 | Gilbert |
| 6,688,989 | B2 | 2/2004 | Best |
| 6,835,144 | B2 | 12/2004 | Best |
| 7,137,903 | B2 | 11/2006 | Best |
| 7,182,698 | B2 | 2/2007 | Tseng |
| 7,481,719 | B2 | 1/2009 | Imamoto |
| 7,597,633 | B2 | 10/2009 | Shimazaki |
| 7,621,822 | B2 | 11/2009 | Roach |
| 7,749,100 | B2 | 7/2010 | Tavares |
| 7,938,738 | B2 | 5/2011 | Roach |
| 8,062,150 | B2 | 11/2011 | Gilbert |
| 8,088,025 | B2 | 1/2012 | Wahl |
| 8,197,354 | B2 | 6/2012 | Gilbert |
| 8,202,174 | B2 | 6/2012 | Breier |
| 8,235,833 | B2 | 8/2012 | Best |
| 8,366,566 | B1 | 2/2013 | Rollinson |
| 8,808,106 | B2 | 8/2014 | Tavares |
| 8,876,630 | B2 | 11/2014 | Takechi |
| 9,044,653 | B2 | 6/2015 | Wahl |
| 9,199,141 | B2 | 12/2015 | Cardani |
| 9,675,852 | B2 | 6/2017 | Westrum |
| 9,731,170 | B2 | 8/2017 | Franklin |
| 9,808,685 | B1 | 11/2017 | Westrum |
| 10,039,964 | B1 | 8/2018 | Westrum |

(Continued)

*Primary Examiner* — Raeann Gorden

(57) ABSTRACT

Described herein are embodiments of an iron-type golf club head comprising a rear opening and an insert. The insert either partially or fully occupies the club head interior cavity. The insert damps vibrations occurring within the club head at impact to provide a desirable sound and feel. The insert is formed of a low-density material, thereby providing a significant damping effect while also creating discretionary mass.

19 Claims, 21 Drawing Sheets

(56) References Cited

U.S. PATENT DOCUMENTS

| | | | | |
|---|---|---|---|---|
| 10,071,291 | B2 | 9/2018 | Daraskavich | |
| 10,099,103 | B2 | 10/2018 | Golden | |
| 10,220,272 | B2 | 3/2019 | Gonzalez | |
| 10,293,223 | B2 | 5/2019 | Kii | |
| 10,325,126 | B2 | 6/2019 | Calvarese | |
| 10,406,410 | B2 | 9/2019 | Wahl | |
| 10,493,336 | B2 | 12/2019 | Taylor | |
| 10,716,979 | B2 | 7/2020 | Hosooka | |
| 10,729,950 | B2 | 8/2020 | Gonzalez | |
| 10,881,926 | B1 | 1/2021 | Hill | |
| 11,020,639 | B2 | 6/2021 | Golden | |
| 11,058,931 | B2 | 7/2021 | Clarke | |
| 11,338,183 | B2 | 5/2022 | Taylor | |
| 11,400,351 | B2 | 8/2022 | Halberg | |
| 11,406,882 | B2 | 8/2022 | Taylor | |
| 11,648,445 | B2 | 5/2023 | Wang | |
| 11,724,166 | B2 | 8/2023 | Golden | |
| 11,998,816 | B2 | 6/2024 | Milleman | |
| 2007/0117653 | A1 | 5/2007 | Yoneyama | |
| 2015/0273287 | A1 | 10/2015 | Doi | |
| 2019/0262673 | A1* | 8/2019 | Clarke | A63B 53/0429 |
| 2020/0298077 | A1* | 9/2020 | Clarke | A63B 53/042 |

* cited by examiner

IRON-TYPE GOLF CLUB HEAD WITH REAR OPENING AND INSERT

CROSS REFERENCE PRIORITIES

This claims the benefit of U.S. Provisional Application No. 63/376,746, filed Sep. 22, 2022, the contents of which are fully incorporated herein by reference.

TECHNICAL FIELD

This disclosure relates generally to hollow-body, iron-type golf club heads and, more particularly, relates to hollow-body golf club heads with one or more rear openings and an insert.

BACKGROUND

Golf club head design considers the balance between performance and the sound and feel of the club head at impact, also known as the "vibrational response." Most iron-type club heads fail to achieve an effective combination of performance and vibrational response, and instead, prioritize one or the other. For example, many "blade-style" or "muscle-back" irons have exceptional vibrational response due to their solid-body constructions. However, the blade-style or muscle-back irons are less forgiving due to the lack of discretionary mass available to optimize performance. In contrast, "hollow-body" irons and "cavity-back" irons are optimized for performance by providing significant amounts of discretionary mass. However, hollow-body and cavity-back irons have a less desirable vibrational response due to their thin walls that experience substantial vibration at impact. There is a need in the art for an iron-type golf club head that improves the balance between performance and vibrational response.

BRIEF DESCRIPTION OF THE DRAWINGS

To facilitate further description of the embodiments, the following drawings are provided in which.

DEFINITIONS

Figure 1:
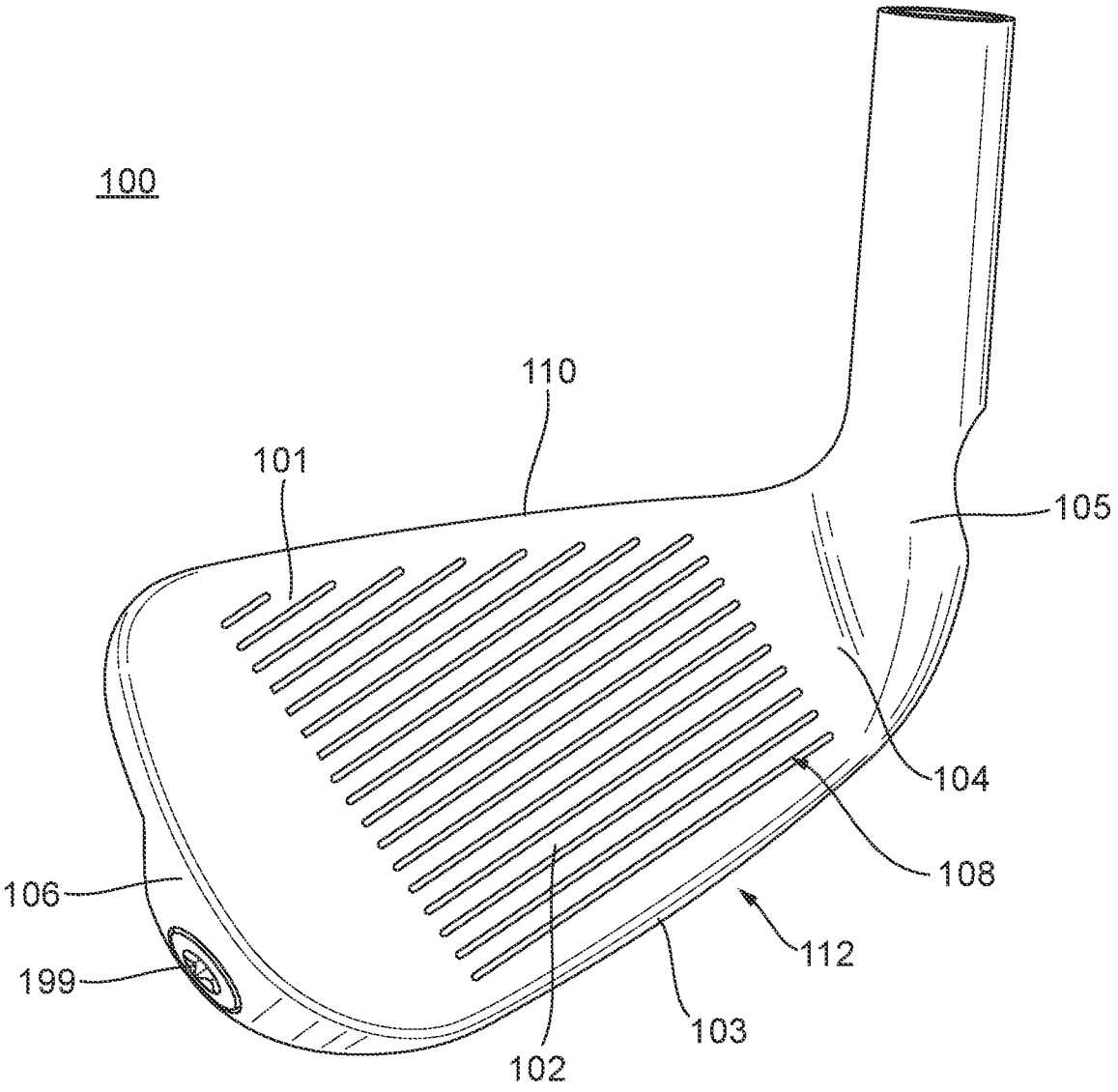
FIG. 1 illustrates a front perspective view of a golf club head comprising a rear opening and an insert.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements or signals, electrically, mechanically and/or otherwise.

Multiple embodiments of a golf club are illustrated in the figures. A golf club is generally understood to comprise a club head, which is configured to receive a shaft. A golf club further comprises a grip, which is secured to the shaft.

FIGS. 1-7 schematically illustrate an iron-type golf club head in various views. The features discussed below are demonstrated on club head 100. For ease of discussion, the features shown on club head 100 are applicable to various embodiments of the club head according to the present invention. Any one or more of the features described in the various embodiments below can be used in combination with one another. Further, while different embodiments may comprise different numbering schemes (i.e. 1xx, 2xx, 3xx numbering schemes, etc.) similar elements are numbered similarly between embodiments (i.e. club head 100 comprises a top rail 110 and a sole 112, whereas club head 200 comprises a top rail 210 and a sole 212).

The club head 100 can comprise body 101, wherein the body comprises a top rail 110, a sole 112 opposite the top rail 110, a heel 104, a toe 106 opposite the heel 104, a front end 108, and a rear end 111 opposite the front end 108. The body 110 can further comprise a rear wall 116 extending at least partially along the rear end 111, between the top rail 110 and the sole 112. The body 101 at least partially encloses an interior cavity 107. The body 110 further comprises a hosel 105 configured to receive the shaft.

In some embodiments, the body material can be a stainless steel, such as 17-4 stainless steel. In other embodiments, the body material can be a steel or stainless steel alloy such as 15-5 stainless steel, 431 stainless steel, 4140 steel, 4340 steel, or any other suitable material. The body material can comprise a density between 7.0 g/cm$^3$ and 10.0 g/cm$^3$. In some embodiments, the body material can comprise a density between 7.0 g/cm$^3$ and 7.5 g/cm$^3$, between 7.5 and 8.0 g/cm$^3$, between 8.0 and 8.5 g/cm$^3$, between 8.5 and 9.0 g/cm$^3$, between 9.0 and 9.5 g/cm$^3$, or between 9.5 and 10.0 g/cm$^3$.

The term "strike face," as used herein, refers to a club head front surface that is configured to strike a golf ball. The term "strike face" can be used interchangeably with the term "face."

The term "strike face perimeter," as used herein, can refer to an edge of the strike face. The strike face perimeter can be located along an outer edge of the strike face where the strike face ceases to be planar. Referring to FIG. 1, the strike face perimeter includes an upper edge 118, which defines a highest point on the strike face 102. The strike face perimeter further includes a leading edge 103, which defines a lowest point on the strike face 102. The strike face perimeter is the outermost bound of the strike face 102.

The "leading edge" of the club head, as described herein, can be identified as the most sole-ward portion of the strike face perimeter. For example, as illustrated in FIG. 1, the leading edge 103 is the transition from the strike face 102 to the sole 112 of the club head 100.

The "geometric center" of the strike face, as used herein, refers to a geometric centerpoint of the strike face perimeter, illustrated in FIGS. 1-7. The geometric center 120 of the strike face 102 can be located in accordance with the definition of a golf governing body such as the United States Golf Association (USGA).

Figure 3:
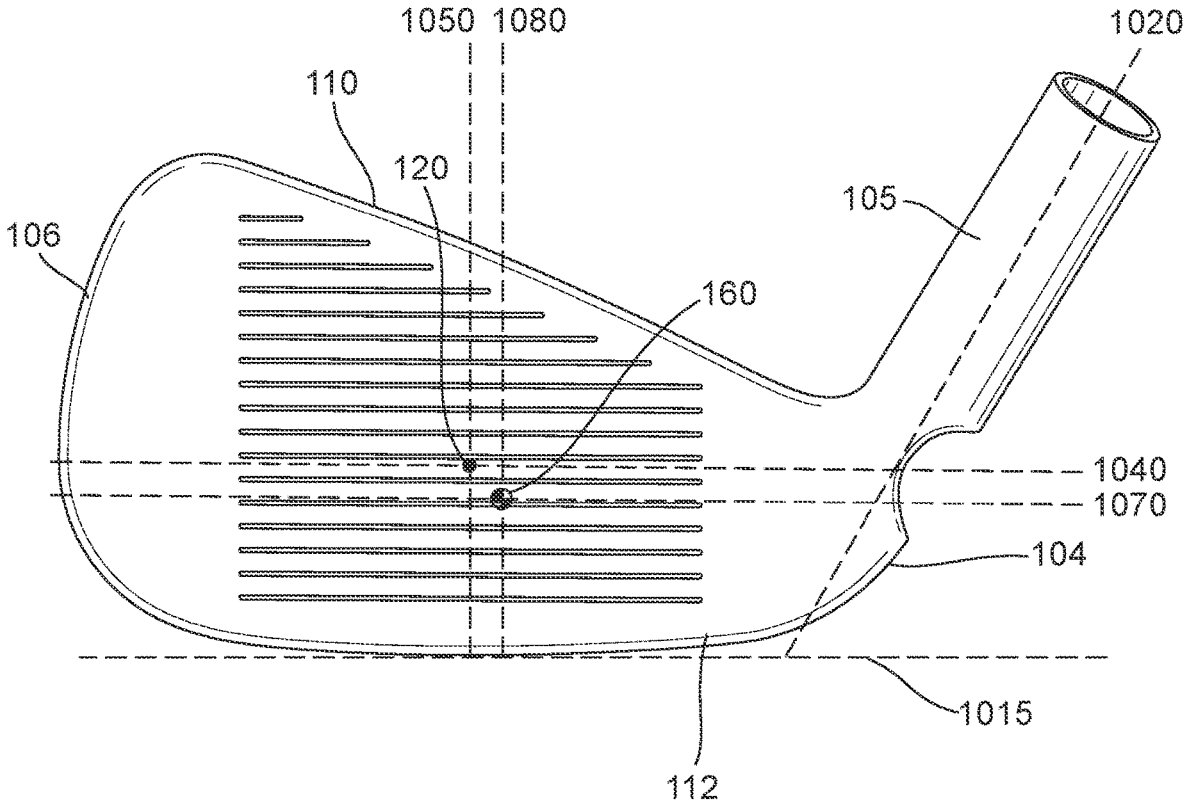
FIG. 3 illustrates a front view of the golf club head of FIG. 1.

The "ground plane," as used herein, refers to a reference plane associated with the surface on which a golf ball is placed. The ground plane 1010 can be a horizontal plane tangent to the sole at an address position. Address position is defined in further detail below. The ground plane 1010 is illustrated in FIG. 3.

Figure 4:
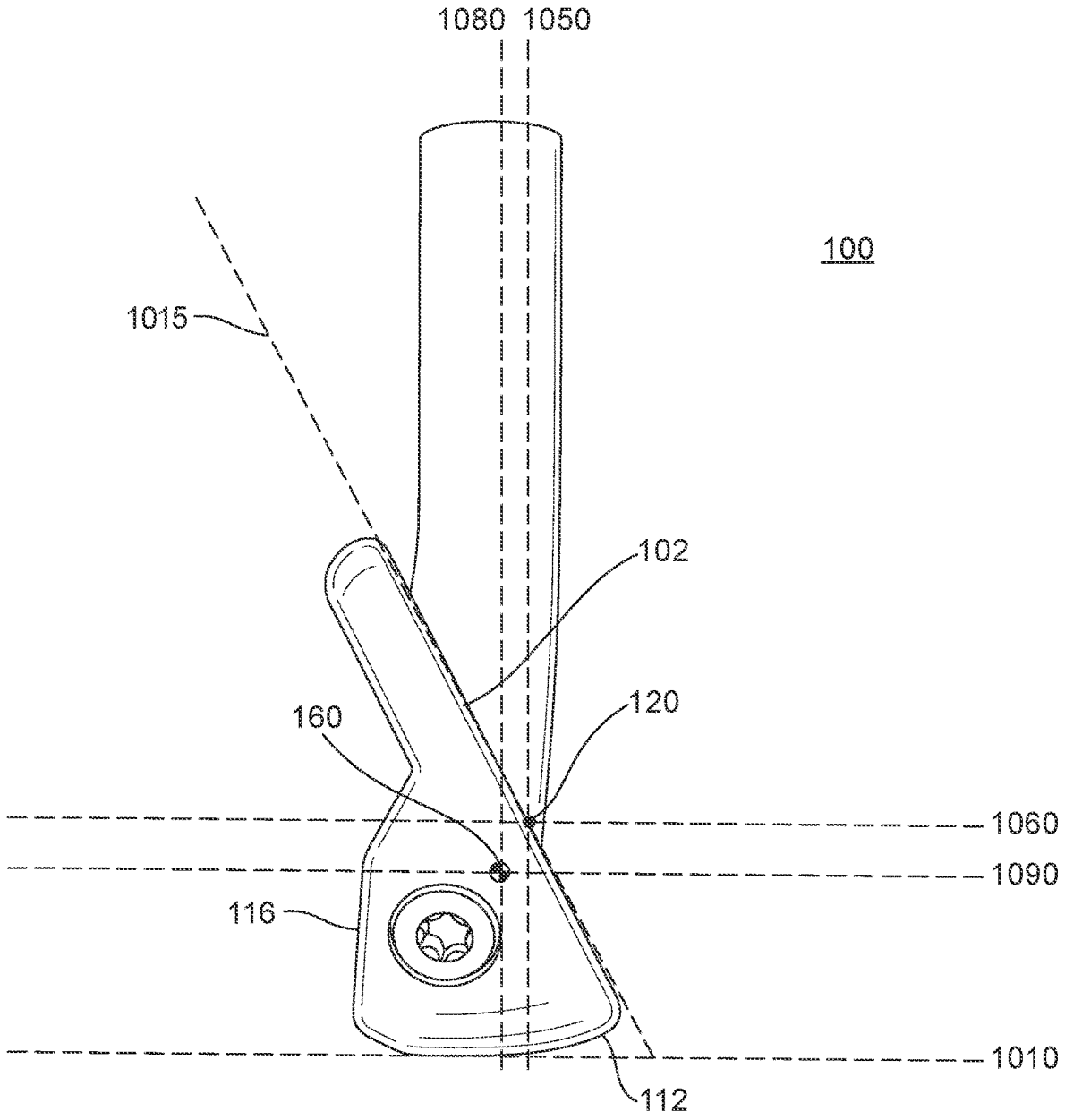
FIG. 4 illustrates a toe-side view of the golf club head of FIG. 1.

The term "loft plane," as used herein, can refer to a reference plane that is tangent to the geometric center of the strike face. Loft plane 1015 is illustrated in FIG. 4.

The term "loft angle," as used herein, can refer to an angle measured between the loft plane and the XY plane (defined below).

The term "lie angle," as used herein, can refer to an angle between a hosel axis 1020, extending through the hosel 105, and the ground plane 1010.

The club head 100 can define an "address position" (also referred to as "address"), wherein the club head 100 is oriented such that club head forms its intended loft angle and lie angle. For example, at address position, the loft plane 1015 and the XY plane form the intended loft angle between one another. Likewise, at address position, the hosel axis 1020 and the ground plane 1010 form the intended lie angle between one another.

As illustrated in FIGS. 3 and 4, the club head 100 can define a primary coordinate system centered about the geometric center 120 of the strike face 102. The primary coordinate system can comprise an X-axis 1040, a Y-axis 1050, and a Z-axis 1060. The X-axis 1040 can extend in a heel-to-toe direction, parallel to the ground plane 1010. The X-axis 1040 can be positive towards the heel 104 and negative towards the toe 106. The Y-axis 1050 can extend in a top rail-to-sole direction and can be orthogonal to both the ground plane 1010 and the X-axis 1040. The Y-axis 1050 can be positive towards the top rail 110 and negative towards the sole 112. The Z-axis 1060 can extend in front-to-rear direction, parallel to the ground plane 1010, and can be orthogonal to both the X-axis 1040 and the Y-axis 1050. The Z-axis 1060 can be positive towards the strike face 102 and negative towards the rear end 111.

The primary coordinate system, as described herein, defines an XY plane as a vertical plane extending along the X-axis 1040 and the Y-axis 1050. The primary coordinate system defines an XZ plane as a horizontal plane extending along the X-axis 1040 and the Z-axis 1060. The primary coordinate system further defines a YZ plane as a vertical plane extending along the Y-axis 1050 and the Z-axis 1060. The XY plane, the XZ plane, and the YZ plane are all perpendicular to one another and intersect at the primary coordinate system origin located at the geometric center 120 of the strike face 102. In these or other embodiments, the club head 100 can be viewed from a front view when the strike face 102 is viewed from a direction perpendicular to the XY plane. Further, in these or other embodiments, the club head 100 can be viewed from a side view or side cross-sectional view when the heel 104 or toe 106 is viewed from a direction perpendicular to the YZ plane.

The "center of gravity" or "CG" of the club head, as described herein, can refer to the point at which the mass is centered within the club head. The CG 160 is illustrated in FIGS. 3 and 4.

The term or phrase "center of gravity position" or "CG location" can refer to the location of the club head center of gravity (CG) with respect to the primary coordinate system, wherein the CG position is characterized by locations along the X-axis 1040, the Y-axis 1050, and the Z-axis 1060. The term "CGx" can refer to the CG location along the X-axis 1040, measured from the geometric center 120. The term "CG height" can refer to the CG location along the Y-axis 1050, measured from the geometric center 120. The term "CGy" can be synonymous with the CG height. The term "CG depth" can refer to the CG location along the Z-axis 1060, measured from the geometric center 120. The term "CGz" can be synonymous with the CG depth. The term "CG ground height" can refer to a vertical displacement (parallel to the Y-axis 1050) of the CG 160, relative to the ground plane 1010. The term "CG leading edge depth" can refer to a horizontal displacement (parallel to the Z-axis 1060) from a forwardmost-point of the leading edge 103. CG leading edge depths can be expressed as negative value for distances rearward of the leading edge 103.

The golf club head further comprises a secondary coordinate system centered about the center of gravity 160. As illustrated in FIGS. 3 and 4, the secondary coordinate system comprises an X'-axis 1070, a Y'-axis 1080, and a Z'-axis 1090. The X'-axis 1070 extends in a heel-to-toe direction. The X'-axis 1070 is positive towards the heel 104 and negative towards the toe 106. The Y'-axis 1080 extends in a sole-to-top rail direction and is orthogonal to both the Z'-axis 1090 and the X'-axis 1070. The Y'-axis 1080 is positive towards the top rail 110 and negative towards the sole 112. The Z'-axis 1090 extends front-to-rear, parallel to the ground plane 1010 and is orthogonal to both the X'-axis 1070 and the Y'-axis 1080. The Z'-axis 1090 is positive towards the strike face 102 and negative towards the rear end 111.

The term or phrase "moment of inertia" (hereafter "MOI") can refer to a value derived using the center of gravity (CG) location. The term "$MOI_{xx}$" or "$I_{xx}$" can refer to the MOI measured about the X'-axis 1070. The term "$MOI_{yy}$" or "$I_{yy}$," can refer to the MOI measured about the Y'-axis 1080. The term "$MOI_{zz}$" or "$I_{zz}$" can refer to the MOI measured about the Z'-axis 1090. The MOI values $MOI_{xx}$, $MOI_{yy}$, and $MOI_{zz}$ determine how forgiving the club head 100 is for off-center impacts with a golf ball.

The term "iron," as used herein, can, in some embodiments, refer to an iron-type golf club head having a loft angle that is less than approximately 50 degrees, less than approximately 49 degrees, less than approximately 48 degrees, less than approximately 47 degrees, less than approximately 46 degrees, less than approximately 45 degrees, less than approximately 44 degrees, less than approximately 43 degrees, less than approximately 42 degrees, less than approximately 41 degrees, or less than approximately 40 degrees. Further, in many embodiments, the loft angle of the club head is greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

In many embodiments, such as for "game improvement irons", the volume of the club head is less than approximately 65 $cm^3$, less than approximately 60 $cm^3$, less than approximately 55 $cm^3$, or less than approximately 50 $cm^3$. In some embodiments, the volume of the club head can be approximately 50 $cm^3$ to 60 $cm^3$, approximately 51 $cm^3$-53 $cm^3$, approximately 53 $cm^3$-55 $cm^3$, approximately 55 $cm^3$-57 $cm^3$, or approximately 57 $cm^3$-59 $cm^3$.

In many embodiments, such as for "player's irons", the volume of the club head is less than approximately 45 $cm^3$, less than approximately 40 $cm^3$, less than approximately 35 $cm^3$, or less than approximately 30 $cm^3$. In some embodiments, the volume of the club head can be approximately 31 $cm^3$-38 $cm^3$ (1.9 cubic inches to 2.3 cubic inches), approximately 31 $cm^3$-33 $cm^3$, approximately 33 $cm^3$-35 $cm^3$, approximately 35 $cm^3$-37 $cm^3$, or approximately 37 $cm^3$-39 $cm^3$.

In some embodiments, the iron can comprise a total mass ranging between 180 grams and 260 grams, 190 grams and 240 grams, 200 grams and 230 grams, 210 grams and 220 grams, or 215 grams and 220 grams. In some embodiments, the total mass of the club head is 215 grams, 216 grams, 217 grams, 218 grams, 219 grams, or 220 grams.

The term or phrase "hollow-body iron" as used herein, refers to an iron-type golf club head having an enclosed interior cavity. Hollow body irons are most often used for increasing distance potential due to the face acting as a springboard or drum, supported by a continuous back wall design.

The term or phrase "cavity-back iron" as used herein, refers to an iron-type golf club head having an open rear cavity. Cavity-back irons typically have the majority of the mass on the perimeter of the body, giving these clubs better forgiveness, which is desirable to high handicap golfers.

In some embodiments, an iron-type club head may comprise a rear opening that is covered by a badge to enclose an interior cavity. In such embodiments, enclosing the rear opening converts an open rear cavity to an enclosed interior cavity. As such, embodiments comprising a badge covering a rear opening can be considered both a cavity-back iron and a hollow-body iron.

The term or phrase "blade-style iron" or "muscle-back iron" as used herein, refers to an iron-type golf club head having a solid body devoid of any cavities, recesses, openings, or voids. Blade-style and muscle-back irons typically exhibit less forgiveness and more workability, making them ideal for low handicap golfers.

The Ixx of the iron-type club head can be between 500 g*$cm^2$ and 2000 g*$cm^2$. In some embodiments, the $I_{xx}$ can be between 500 and 800 g*$cm^2$, 800 and 1100 g*$cm^2$, 1100 and 1400 g*$cm^2$, 1400 and 1700 g*$cm^2$, or between 1700 and 2000 g*$cm^2$. In some embodiments, the Ixx can be greater than 500 g*$cm^2$, 600 g*$cm^2$, 700 g*$cm^2$, 800 g*$cm^2$, 900 g*$cm^2$, 1000 g*$cm^2$, 1100 g*$cm^2$, 1200 g*$cm^2$, 1300 g*$cm^2$, 1400 g*$cm^2$, 1500 g*$cm^2$, 1600 g*$cm^2$, 1700 g*$cm^2$, 1800 g*$cm^2$, or greater than 1900 g*$cm^2$.

The Iyy of the iron-type club head can be between 2000 g*$cm^2$ and 4000 g*$cm^2$. In some embodiments, the $I_{yy}$ can be between 2000 and 2250 g*$cm^2$, 2250 g*$cm^2$ and 2500 g*$cm^2$, 2500 and 2750 g*$cm^2$, 2750 and 3000 g*$cm^2$, 3000 and 3250 g*$cm^2$, 3250 and 3500 g*$cm^2$, 3500 and 3750 g*$cm^2$, or between 3750 and 4000 g*$cm^2$. In some embodiments, the Iyy can be greater than 2000 g*$cm^2$, 2100 g*$cm^2$, 2200 g*$cm^2$, 2300 g*$cm^2$, 2400 g*$cm^2$, 2500 g*$cm^2$, 2600 g*$cm^2$, 2700 g*$cm^2$, 2800 g*$cm^2$, 2900 g*$cm^2$, 3000 g*$cm^2$, 3100 g*$cm^2$, 3200 g*$cm^2$, 3300 g*$cm^2$, 3400 g*$cm^2$, 3500 g*$cm^2$, 3600 g*$cm^2$, 3700 g*$cm^2$, 3800 g*$cm^2$, or greater than 3900 g*$cm^2$.

The Izz of the iron-type club head can be between 2000 g*$cm^2$ and 4000 g*$cm^2$. In some embodiments, the $I_{zz}$ can be between 2000 and 2250 g*$cm^2$, 2250 g*$cm^2$ and 2500 g*$cm^2$, 2500 and 2750 g*$cm^2$, 2750 and 3000 g*$cm^2$, 3000 and 3250 g*$cm^2$, 3250 and 3500 g*$cm^2$, 3500 and 3750 g*$cm^2$, or between 3750 and 4000 g*$cm^2$. In some embodiments, the Iyy can be greater than 2000 g*$cm^2$, 2100 g*$cm^2$, 2200 g*$cm^2$, 2300 g*$cm^2$, 2400 g*$cm^2$, 2500 g*$cm^2$, 2600 g*$cm^2$, 2700 g*$cm^2$, 2800 g*$cm^2$, 2900 g*$cm^2$, 3000 g*$cm^2$, 3100 g*$cm^2$, 3200 g*$cm^2$, 3300 g*$cm^2$, 3400 g*$cm^2$, 3500 g*$cm^2$, 3600 g*$cm^2$, 3700 g*$cm^2$, 3800 g*$cm^2$, or greater than 3900 g*$cm^2$.

The CGy location of the iron-type club head can be between −0.10 and −0.25 inch. In some embodiments, the CGy location can be between −0.10 and −0.15 inch, between −0.15 and −0.20 inch, or between −0.20 and −0.25 inch. In some embodiments, the CGy location can be less than −0.10 inch, less than −0.12 inch, less than −0.14 inch, less than −0.16 inch, less than −0.18 inch, less than −0.20 inch, less than −0.22 inch, less than −0.24 inch, or less than −0.25 inch The CGz location of the iron-type club head can be between −0.15 and −0.05 inch. In some embodiments, the CGz location can be between −0.15 and −0.13 inch, between −0.13 and −0.11 inch, between −0.11 and −0.09 inch, between −0.09 and −0.07 inch, or between −0.07 and −0.05 inch. In some embodiments, the CGz location can be greater than −0.15 inch, less than −0.13 inch, less than −0.11 inch, less than −0.09 inch, less than −0.07 inch, or less than −0.05 inch.

The CG ground height of the iron-type club head can be between 0.25 inch and 0.75 inch. In some embodiments, the CG ground height can be between 0.25 inch and 0.35 inch, between 0.35 inch and 0.45 inch, between 0.45 inch and 0.55 inch, between 0.55 inch and 0.65 inch, or between 0.65 inch and 0.75 inch. In some embodiments, the CG ground height can be less than 0.75 inch, less than 0.65 inch, less than 0.55 inch, less than 0.45 inch, less than 0.35 inch, or less than 0.25 inch.

The CG leading edge depth of the iron-type club head can be between −0.25 inch and −0.75 inch. In some embodiments, the CG ground height can be between −0.25 inch and −0.35 inch, between −0.35 inch and −0.45 inch, between −0.45 inch and −0.55 inch, between −0.55 inch and −0.65 inch, or between −0.65 inch and −0.75 inch. In some embodiments, the CG ground height can be greater than −0.75 inch, greater than −0.65 inch, greater than −0.55 inch, greater than −0.45 inch, greater than −0.35 inch, or greater than −0.25 inch.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

DESCRIPTION

Described herein are various embodiments of iron-type golf club heads comprising inserts that optimize vibration damping and performance characteristics. The inserts described herein damp vibrations while preserving high amounts of discretionary mass. The inserts are received within an interior cavity of the club head via one or more rear openings and can either partially or fully occupy the interior cavity.

The insert provides a club head that improves the balance between performance and vibration damping. The insert can contact a significant portion of the club head body and damp vibrations occurring therein. The insert can be formed of a lightweight material with a density lower than the density of the body. As such, the insert provides a significant vibration damping effect without contributing a significant amount of mass to the club head. The insert increases discretionary mass relative to a blade-style iron by effectively replacing portions of the high-density body with a lower-density material. In many embodiments, the insert can provide a club head with a multi-material, solid construction that provides similar vibrational characteristics to the solid construction of a blade-style iron. In many embodiments, the club head comprising one or more rear openings and a lightweight insert can create 25 grams or more of additional discretionary mass, in relation to a similar blade-style iron with a solid, single material body. In comparison to a hollow-body or cavity back iron, the club head described herein can damp vibrations and provide a preferable sound and feel, while retaining or improving performance.

In some specific embodiments, at least one surface of the insert can be exposed to the rear exterior of the club head via the one or more rear openings. In some embodiments, the insert comprises an exposed exterior surface that forms greater than 30% of the surface area of the rear wall. Leaving the exterior surface of the insert exposed via the rear opening retains discretionary mass. The rear opening removes mass from the rear wall, and leaving the exterior surface of the insert exposed means no mass is reintroduced to cover the opening. In other embodiments, the one or more rear openings can be covered and/or sealed by one or more badges. In such embodiments, the one or more badges can cover the exterior surface of the insert and the insert can be concealed within the interior cavity. In some specific embodiments, no surface of the insert is exposed to the exterior of the club head. Covering and/or sealing the one or more rear openings with a badge can protect the insert from the exterior of the club head. As such, the insert can be provided with a lower density and/or lower hardness without compromising the durability of the insert, thereby increasing discretionary mass.

In some embodiments, the insert can comprise a lattice structure having a plurality of internal and/or external voids. As such, the lattice structure insert has an effective density that is lower density of the material used to form the insert. Further, the effective density of the lattice insert can be varied strategically to improve the club head mass properties. In some embodiments, the lattice insert can comprise a uniform effective density, wherein the uniform effective density can be varied between different embodiments. In some embodiments, the lattice insert can comprise a variable effective density, such that the effective density is greater in certain portions of the insert and lower in other portions of the insert. In such embodiments, the variable effective density within the lattice insert can be manipulated to achieve a desired mass distribution.

I. General Description of Elements

A. Rear Openings

Figure 5:
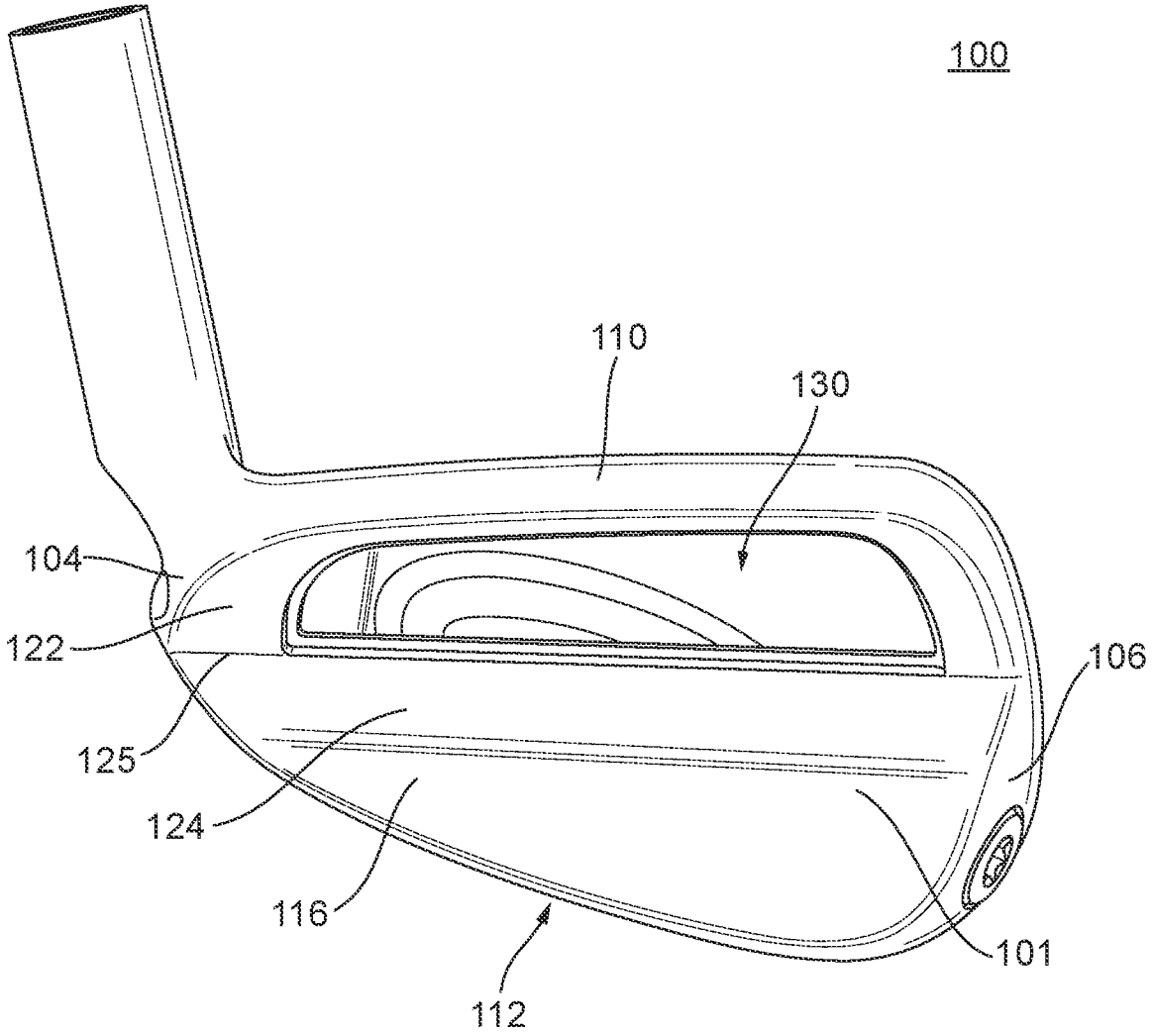
FIG. 5 illustrates a rear view of the golf club head of FIG. 1 with the insert removed.
Figure 6:
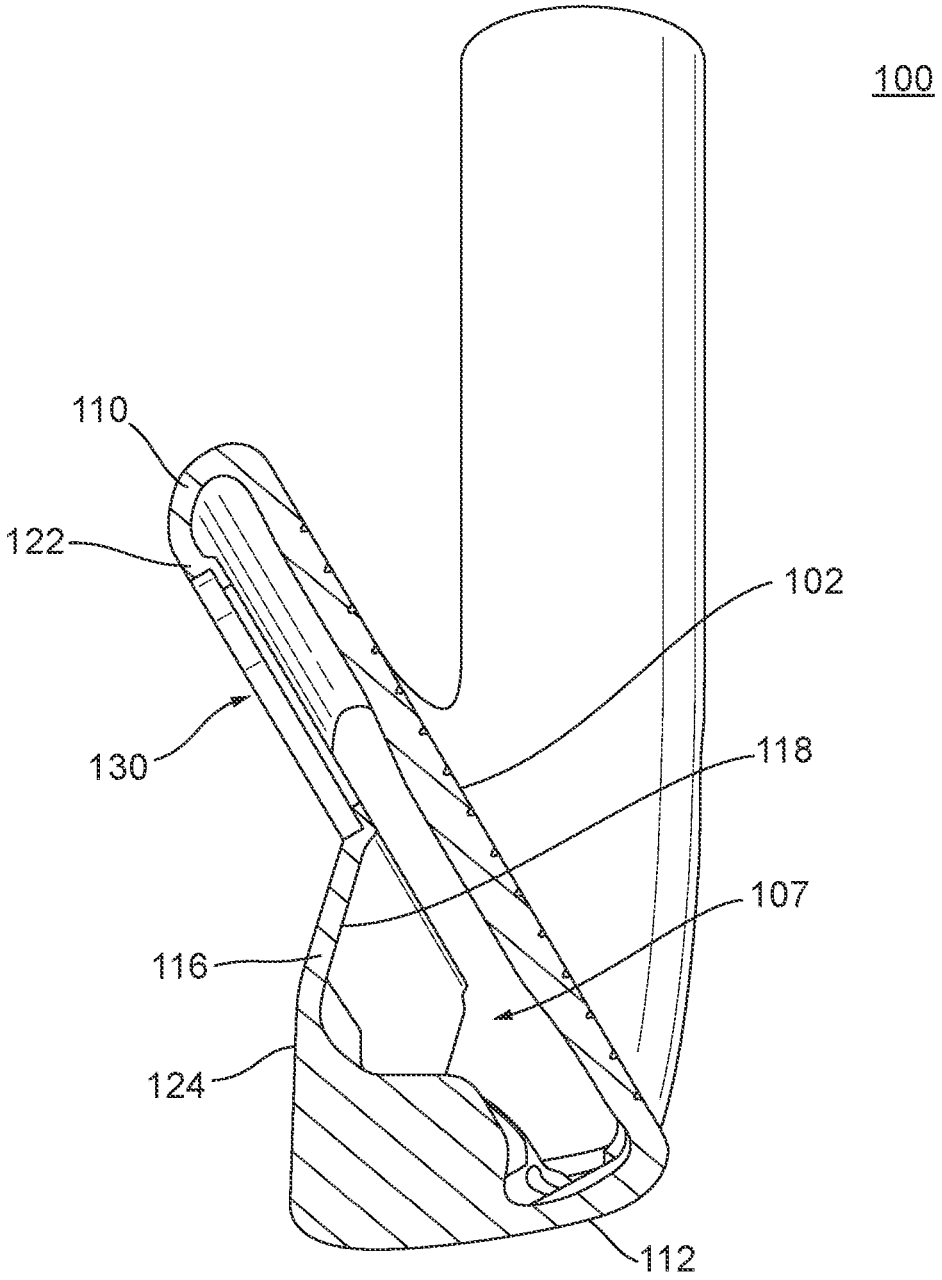
FIG. 6 illustrates a toe-side cross-sectional view of the golf club head of FIG. 1 with the insert removed.

FIGS. 1-7 illustrate an iron-type club head comprising an insert and one or more rear openings in the body. Referring to FIGS. 5 and 6, the club head can comprise one or more openings into the interior cavity. The club head comprises a rear wall, wherein a rear opening is formed through the rear wall. The rear opening fluidly communicates the exterior of the club head to the interior cavity. The rear opening provides multiple purposes. The rear opening creates discretionary mass by removing mass in the rear wall, in comparison to a hollow-body iron that comprises a continuous rear wall to enclose the interior cavity or a blade-style iron with a solid body construction. Further, the rear opening provides access to the interior cavity that allows an insert (described in further detail below) to be placed therein.

As illustrated in FIGS. 5 and 6, the rear wall can be divided into an upper rear wall and a lower rear wall. The rear wall can comprise an inflection seam extending across the rear wall in a substantially horizontal direction from proximate the heel to proximate the toe. In many embodiments, the inflection seam can provide a boundary between the upper rear wall and lower rear wall. The upper rear wall can be located between (or bounded by) the top rail and the inflection seam. The lower rear wall can be located between (or bounded by) the inflection seam and the sole.

With continued reference to FIGS. 5 and 6, the club head comprises a single opening located in the upper rear wall. In some embodiments, many of which are described in further detail below, the club head can comprise one or more openings located in the upper rear wall, one or more openings in the lower rear wall, or a combination thereof. In some embodiments, the club head can comprise one opening, two openings, three openings, four openings, five openings, or any suitable number of openings in the upper rear wall. In some embodiments, the club head can comprise one opening, two openings, three openings, four openings, five openings, or any suitable number of openings in the lower rear wall. In some embodiments, the club head can comprise any combination of any number of openings in the upper rear wall and any number of openings in the lower rear wall.

In some embodiments, the rear opening can cover a significant portion of the rear wall. The size of the rear opening can be characterized by an opening exposure area. The opening exposure area can be calculated as the 2-dimensional surface area of the rear opening projected onto the loft plane. In some embodiments, the rear opening comprises an opening exposure area between 0.50 and 3.50 $in^2$. In embodiments comprising multiple rear openings, the rear openings can each separately have an opening exposure area within the ranges listed above. Further, in said embodiments comprising multiple rear openings, the rear openings can have a combined opening exposure area between 0.80 and 4.00 int.

The size of the rear opening can further be characterized by comparing the opening exposure area to the surface area of the rear wall. For the sake of comparison, the surface area of the rear wall is measured as if the rear wall were continuous and devoid of any openings. The surface area of the rear wall can be calculated by replacing the rear opening with an imaginary plane forming the portion of the rear wall that is removed by the rear opening. In some embodiments, the rear opening comprises an opening exposure area between 15% and 85% of the rear wall surface area. In some embodiments, the rear opening comprises an opening exposure area between 15% and 25%, 25% and 35%, 35% and 45%, 45% and 55%, 55% and 65%, 65% and 75%, or between 75% and 85% of the rear wall surface area. In some embodiments, the rear opening comprises an opening exposure area greater than 15%, 20%, 25%, 30%, 35%, 40%, 45%, 50%, 55%, 60%, 65%, 70%, 75%, 80%, or greater than 85% of the rear wall surface area. In embodiments comprising multiple rear openings, the rear openings can each separately have an opening exposure area within the percentages listed above. Further, in said embodiments comprising multiple rear openings, the rear openings can have a combined opening exposure area between 25% and 95% of the rear wall surface. In some embodiments, the combined opening exposure area can range between 25% and 35%, 35% and 45%, 45% and 55%, 55% and 65%, 65% and 75%, 75% and 85%, or between 85% and 95% of the rear wall surface. In some embodiments, the combined opening exposure area can be greater than 25%, 30%, 35%, 40%, 45%, 50%, 55%, 60%, 65%, 70%, 75%, 80%, 85%, 90% or greater than 95% of the rear wall surface.

As described above, the rear opening removes mass from the rear wall, creating discretionary mass over both hollow-body irons and blade-style irons. In particular, providing one or more rear openings helps improve the club head CG location. The rear opening removes mass from the rear wall, thereby moving the CG forward. Similarly, in embodiments wherein the rear opening is provided on an upper rear wall (described in further detail below), the rear opening removes mass located high on the club head, thereby moving the CG lower. Providing a lower and more forward CG position in an iron-type club head improves the launch characteristics by increasing ball speed and launch angle at impact. As such, providing one or more rear openings and/or one or more rear openings in the upper rear wall can provide a CG ground height less than 0.75 inch, less than 0.65 inch, less than 0.55 inch, less than 0.45 inch, less than 0.35 inch, or less than 0.25 inch and/or a CG leading edge depth greater than −0.75 inch, greater than −0.65 inch, greater than −0.55 inch, greater than −0.45 inch, greater than −0.35 inch, or greater than −0.25 inch.

B. Inserts

Figure 2:
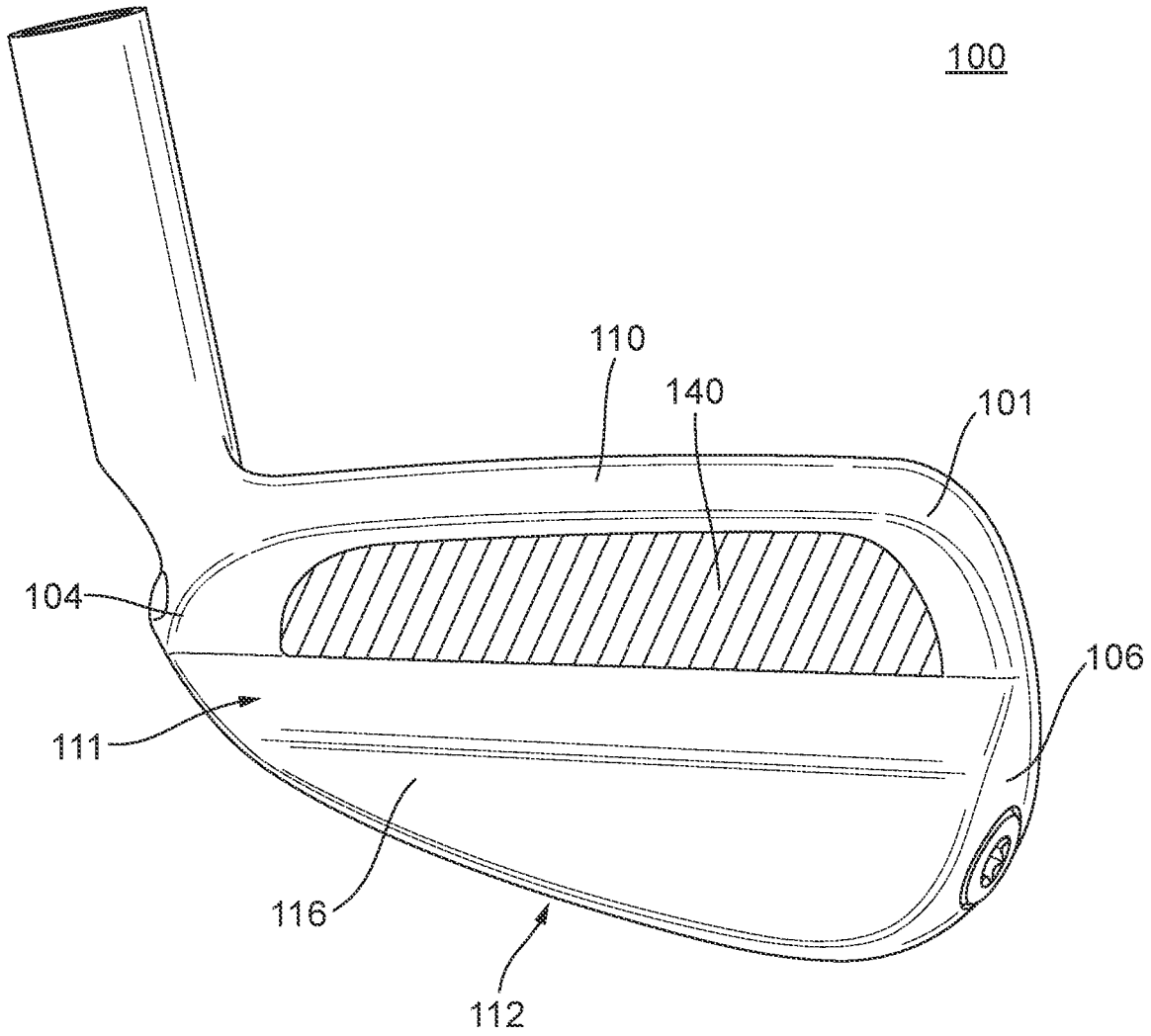
FIG. 2 illustrates a rear perspective view of the golf club head of FIG. 1.
Figure 7:
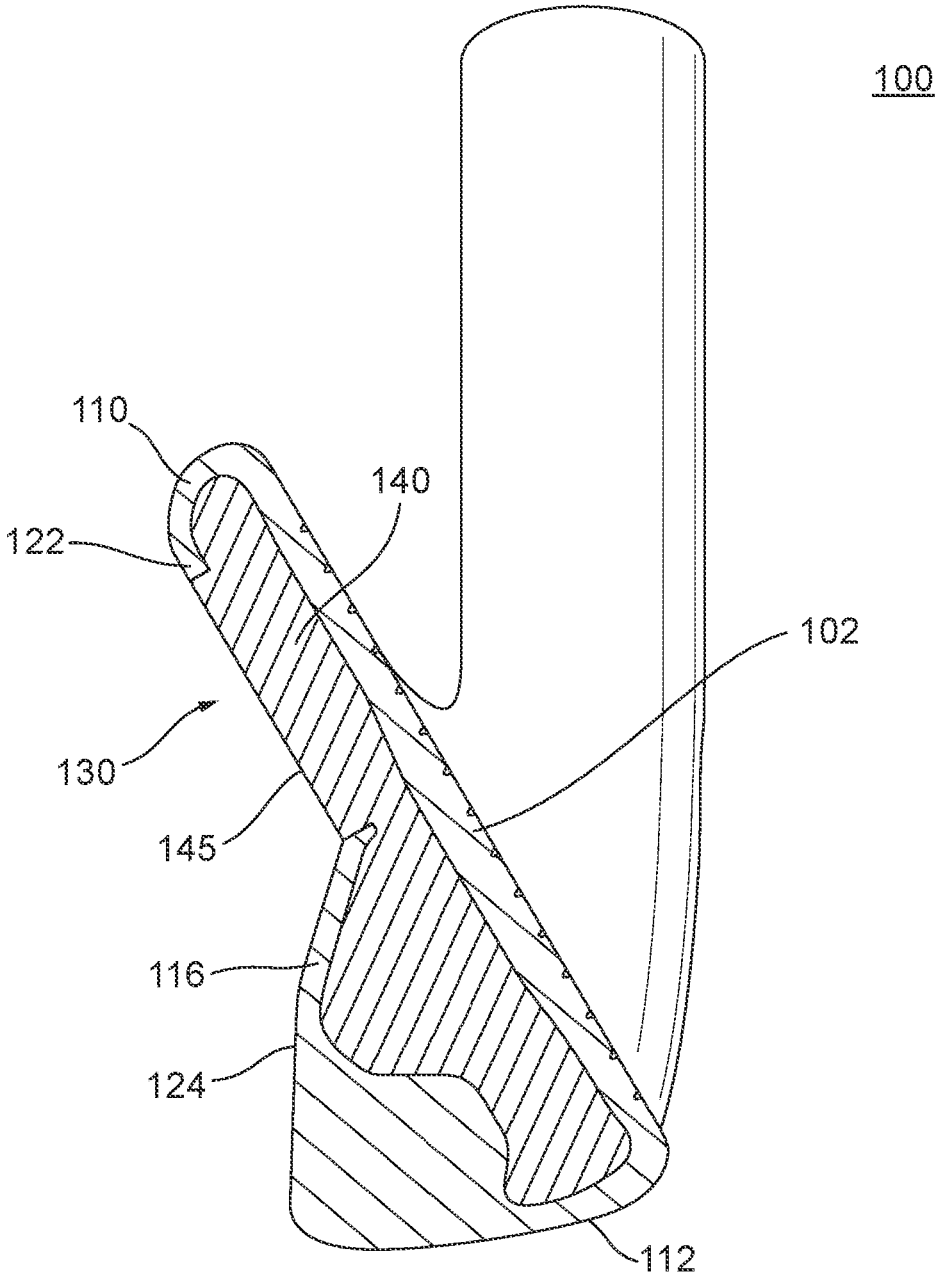
FIG. 7 illustrates a toe-side cross-sectional view of the golf club head of FIG. 1.

Referring to FIGS. 2 and 7, the golf club head further comprises a low-density insert configured to fit within the interior cavity. The insert improves the sound and feedback (or "feel") characteristics of the club head by damping vibrations occurring within the interior surfaces of the club head body that form the interior cavity. The insert can provide a significant contact area against the interior surfaces of the club head body. In particular, the insert can provide a significant contact area against the strike face rear surface, to damp vibrations occurring in the strike face at impact. Further, the insert comprises a low-density material that can replace high-density core body material relative to a blade-type iron, thereby creating discretionary mass.

The insert material can comprise an elastomer, a thermoplastic, a thermoplastic polyurethane (TPU), a thermoplastic elastomer (TPE), a polyurethane (PU), a thermoplastic composite (TPC) or any other suitable polymer. For example, in some embodiments, the insert material can be an ethylene-vinyl acetate polyurethane (EVA PU). In alternate embodiments, the insert material is a low-density polyethylene (LDPE), a polyethylene (PE), a nitrile rubber (NBR), neoprene, polyimide, polypropylene (PP), polystyrene (PS), polyethylene, polyvinyl chloride (PVC), ethylene, vinyl acetate, polyolefin copolymer, styrene, styrene-butadiene, polyurethane elastomer, a silicone elastomer, a rubber, or a vulcanized natural rubber latex, epoxy, a resin, an adhesive, a polyurethane adhesive, a glue, silicone, or any combination thereof. In some embodiments, the insert material can comprise a combined material such as an elastomer comprising a metal powder. In some embodiments, the insert material can be a material that is suitable for forming via additive manufacturing, such as 3D printing. In many embodiments, the insert can be a solidly formed polymer, a polymer foam, a lightweight viscoelastic foam, a metal foam, a lattice, or a combination of said compositions.

The insert is formed of a substantially lightweight material that provides a high level of damping while retaining discretionary mass. The insert comprises a density less than the density of the club head body. In some embodiments, the insert density can range from 0.75 $g/cm^3$ to 2 $g/cm^3$. In some embodiments, the insert density can be between 0.75 and 0.85 $g/cm^3$, between 0.85 $g/cm^3$ and 1.0 $g/cm^3$, between 1.0 $g/cm^3$ and 1.1 $g/cm^3$, between 1.1 $g/cm^3$ and 1.2 $g/cm^3$, between 1.2 $g/cm^3$ and 1.3 $g/cm^3$, between 1.3 $g/cm^3$ and 1.4 $g/cm^3$, between 1.4 $g/cm^3$ and 1.5 $g/cm^3$, between 1.5 $g/cm^3$ and 1.6 $g/cm^3$, between 1.6 $g/cm^3$ and 1.7 $g/cm^3$, between 1.7 $g/cm^3$ and 1.8 $g/cm^3$, between 1.8 $g/cm^3$ and 1.9 $g/cm^3$, or between 1.9 $g/cm^3$ and 2.0 $g/cm^3$. In some embodiments, the insert density can be less than 2.0 $g/cm^3$, less than 1.8 $g/cm^3$, less than 1.6 $g/cm^3$, less than 1.4 $g/cm^3$, less than 1.2 $g/cm^3$, less than 1.0 $g/cm^3$, less than 0.8 $g/cm^3$, or less than 0.75 $g/cm^3$. The lightweight density of the insert creates discretionary mass over a blade-style iron by replacing high-density body material with lower-density insert material. In some embodiments, the insert comprises a uniform density. In other embodiments, the insert can comprise a density that varies throughout the insert.

The density of the insert can be significantly lower than the density of the body. The club head can comprise an insert density ratio defined as the density of the insert divided by the density of the body. In many embodiments, the insert density ratio can be between 0.10 and 0.40. In many embodiments, the insert density ratio can be between 0.10 and 0.20, between 0.15 and 0.25, between 0.20 and 0.30, between 0.25 and 0.35, or between 0.30 and 0.40. In many embodiments, the insert density ratio can be less than 0.40, less than 0.35, less than 0.30, less than 0.25, less than 0.20, less than 0.15, or less than 0.10.

The insert density can be different for embodiments wherein the insert is exposed to the club head exterior than for embodiments wherein the insert is covered by a badge (described in further detail below). In some embodiments wherein the insert is exposed, the insert density can range between 1.0 g/cm$^3$ and 2.0 g/cm$^3$. In some embodiments wherein the insert is exposed, the insert density can be greater than 1.0 g/cm$^3$, greater than 1.1 g/cm$^3$, greater than 1.2 g/cm$^3$, greater than 1.3 g/cm$^3$, greater than 1.4 g/cm$^3$, greater than 1.5 g/cm$^3$, greater than 1.6 g/cm$^3$, greater than 1.7 g/cm$^3$, greater than 1.8 g/cm$^3$, or greater than 1.9 g/cm$^3$. When the insert is exposed, the insert material may be required to comprise a higher density (i.e. greater than 1.0 g/cm$^3$), to protect the insert from environmental damage.

In embodiments wherein the insert is covered by a badge, the insert density can range between 0.75 g/cm$^3$ and 1.5 g/cm$^3$. In some embodiments wherein the insert is covered by a badge, the insert density can be less than 1.5 g/cm$^3$, less than 1.4 g/cm$^3$, less than 1.3 g/cm$^3$, less than 1.2 g/cm$^3$, less than 1.1 g/cm$^3$, less than 1.0 g/cm$^3$, less than 0.9 g/cm$^3$, less than 0.8 g/cm$^3$, or less than 0.75 g/cm$^3$. When the insert is covered by a badge, the badge provides protection against environmental damage. Therefore, the insert material can be as light as possible (i.e., a density less than 1.5 g/cm$^3$), without concern for durability.

The insert provides a high level of damping without contributing a significant amount of mass to the club head. In many embodiments, the insert can comprise a mass ranging between 0.5 gram and 30 grams. In some embodiments, the mass of the insert can range between 0.5 and 5 grams, 5 and 10 grams, 10 and 15 grams, 15 and 20 grams, 20 and 25 grams, or range between 25 and 30 grams. In some embodiments, the mass of the insert can be less than 25 grams, less than 20 grams, or less than 15 grams. In some embodiments, the mass of the insert can be less than 10 grams, less than 9 grams, less than 8 grams, less than 7 grams, less than 6 grams, less than 5 grams, less than 4 grams, less than 3 grams, less than 2 grams, less than 1 gram, or less than 0.5 gram. As discussed above, the insert is formed of a lightweight material. Throughout different embodiments, the insert mass can vary depending on the size of the club head, the interior cavity volume, the insert density, and the insert volume.

In some embodiments, as illustrated in FIGS. 2 and 7, the insert is exposed to the exterior of the club head. In such embodiments, the insert comprises an insert exterior surface that is exposed via the rear opening. A portion of the insert can extend through the rear opening and at least partially occupy the rear opening. In such embodiments, the insert exterior surface forms at least a portion of the rear surface of the club head. In some embodiments, the insert exterior surface can be flush with the surrounding surfaces of the rear wall. In other embodiments, the insert exterior surface can be inset from the surrounding surfaces of the rear wall, such that the insert does not fully extend through the rear opening. The degree to which the insert is exposed can be characterized by an insert exposure area. The insert exposure area is the surface area of the insert exterior surface that is exposed and/or visible through the rear opening. In some embodiments, the club head comprises an insert exposure area between 0.50 and 4.00 in$^2$. In some embodiments, the insert exposure area can be between 0.50 and 1.00 in$^2$, 1.00 and 1.50 in$^2$, 1.50 and 2.00 in$^2$, 2.00 and 2.50 in$^2$, 2.50 and 3.00 in$^2$, 3.00 and 3.50 in$^2$, or between 3.50 and 4.00 in$^2$. In some embodiments, the insert exposure area can be greater than 0.50 in$^2$, 0.70 in$^2$, 0.90 in$^2$, 1.10 in$^2$, 1.30 in$^2$, 1.50 in$^2$, 1.70 in$^2$, 1.90 in$^2$, 2.10 in$^2$, 2.30 in$^2$, 2.50 in$^2$, 2.70 in$^2$, 2.90 in$^2$, 3.10 in$^2$, 3.30 in$^2$, 3.50 in$^2$, 3.70 in$^2$, or greater than 3.90 in$^2$.

In some embodiments, the insert comprises a hardness ranging from Shore A10 to Shore D80. In some embodiments, the insert hardness can be between Shore A10 and Shore A30, between Shore A30 and Shore A50, between Shore A50 and Shore A70, between Shore 70A and Shore A90, between Shore D40 and Shore D50, between Shore D50 and Shore D60, between Shore D60 and Shore D70, or between Shore D70 and Shore D80. In some embodiments, the insert comprises a uniform hardness. In other embodiments, the insert can comprise a hardness that varies throughout the insert.

In embodiments wherein the insert is exposed to the exterior of the club head, the insert hardness may be greater than the hardness of the insert in an embodiment wherein the insert is covered by a badge. In embodiments wherein the insert is exposed to the exterior of the club head, the insert hardness can be between Shore A60 to Shore D80. In some exposed insert embodiments, the insert hardness can be greater than Shore A60, greater than Shore A70, greater than Shore A80, greater than Shore A90, greater than Shore D40, greater than Shore D50, greater than Shore D60, greater than Shore D70, or greater than Shore D80. When the insert is exposed, the insert material may be required to comprise a greater hardness (i.e., greater than Shore A60) to protect the insert from environmental damage.

In embodiments wherein the insert is covered by a badge, the insert hardness can be between Shore A10 and Shore A60. In some covered insert embodiments, the insert hardness can be less than Shore A60, less than Shore A50, less than Shore A40, less than Shore A30, less than Shore A20, or less than Shore A10. When the insert 140 is covered by a badge, the badge provides protection against environmental damage. Therefore, the insert material can be as soft as necessary (i.e., less than Shore A60), without concern for durability.

In some embodiments, the insert fully occupies the interior cavity. In such embodiments, the insert is formed to complement the shape of the interior cavity. The insert can fully occupy the interior cavity such that the insert contacts an entirety of the interior surfaces of the club head body forming the interior cavity. In some embodiments wherein the insert fully occupies the interior cavity, the insert is substantially solid, such that no voids are formed within the insert. In embodiments wherein the insert fully occupies the interior cavity, the insert and the club head body combine to form a multi-material, solid construction without any voids or spaces therebetween. The multi-material, solid construction of said embodiments increases the balance between vibration damping and performance by mimicking the single-material solid construction of a blade-style iron, but with more discretionary mass.

Relative to a hollow-body iron, providing an insert can increase forgiveness when it fully occupies the interior cavity. Typical hollow-body irons exhibit irregular bending on off-center hits, resulting in "flier" golf shots that fail to spin and travel much further than intended. The insert fully occupies the entire interior cavity and stabilizes the bending of the club head. The stabilization of club head bending produces more predictable shot distances, especially on off-center strikes.

In other embodiments, the insert may only partially occupy the interior cavity. Providing an insert that partially occupies the interior cavity can provide even greater discretionary mass relative to embodiments with inserts that fully occupy the interior cavity, while still providing a high level of vibration damping. In embodiments wherein the insert partially occupies the interior cavity, voids and/or spaces remain within the interior cavity. In some embodiments, the club head can comprise a solid insert that only resides within a specific portion of the interior cavity. In such embodiments, one or more voids and/or spaces can be formed between the insert and the body. In other embodiments, the club head can comprise an insert that resides within the entire interior cavity, but includes a lattice structure that provides one or more voids and/or spaces within the insert itself. Although the profile of the lattice insert may reside within the entire interior cavity, the lattice insert is still considered to partially occupy the cavity, due to the voids within the insert itself. Embodiments of inserts comprising lattice structures are described in further detail below.

In some embodiments, the insert can comprise a volume between 2 $cm^3$ and 25 $cm^3$. In some embodiments, the insert can comprise a volume between 2 and 5 $cm^3$, 5 and 10 $cm^3$, 10 and 15 $cm^3$, 15 and 20 $cm^3$, or between 20 and 25 $cm^3$. In some embodiments, the insert can comprise a volume greater than 2 $cm^3$, 3 $cm^3$, 4 $cm^3$, 5 $cm^3$, 6 $cm^3$, 7 $cm^3$, 8 $cm^3$, 9 $cm^3$, 10 $cm^3$, 11 $cm^3$, 12 $cm^3$, 13 $cm^3$, 14 $cm^3$, 15 $cm^3$, 16 $cm^3$, 17 $cm^3$, 18 $cm^3$, 19 $cm^3$, 20 $cm^3$, 21 $cm^3$, 22 $cm^3$, 23 $cm^3$, 24 $cm^3$, or greater than 25 $cm^3$. In embodiments wherein the insert fully occupies the interior cavity, the volume of the insert can be substantially the same as the volume of the interior cavity. In embodiments where the insert partially occupies the interior cavity, the volume of the insert can be less than the volume of the interior cavity.

In some embodiments wherein the insert only partially occupies the interior cavity, the insert can occupy between 5% and 85% of the volume of the interior cavity. In some embodiments, the insert can occupy between 5% and 15%, 15% and 25%, 25% and 35%, 35% and 45%, 45% and 55%, 55% and 65%, 65% and 75%, or between 75% and 85% of the volume of the interior cavity. In some embodiments, the insert can occupy greater than 5%, 10%, 15%, 20%, 25%, 30%, 35%, 40%, 45%, 50%, 55%, 60%, 65%, 69%, 70%, 75%, 80%, or greater than 85% of the volume of the interior cavity. Although the club head comprises one or more rear openings, the volume of the interior cavity can be considered by covering the one or more rear openings with an imaginary surface and enclosing a defined volume within.

As discussed above, providing and insert fully or partially occupies the interior cavity creates discretionary mass over a blade-style iron, which comprises a solid construction formed entirely of a high-density body material. In embodiments wherein the insert fully occupies the interior cavity, the insert can create between 5 grams and 25 grams of discretionary mass, relative to a similarly shaped blade-style iron. In some embodiments wherein the insert fully occupies the interior cavity, the insert can create more than 5 grams, more than 10 grams, more than 15 grams, more than 20 grams, or more than 25 grams of discretionary mass, relative to a similarly shaped blade-style iron. Further, in embodiments wherein the insert partially occupies the interior cavity, the insert can create between 15 grams and 40 grams of discretionary mass, relative to a similarly shaped blade-style iron. In some embodiments wherein the insert partially occupies the interior cavity, the insert can create more than 15 grams, more than 20 grams, more than 25 grams, more than 30 grams, more than 35 grams, or more than 40 grams of discretionary mass, relative to a similarly shaped blade-style iron.

The amount of discretionary mass created by replacing the solid construction of a blade-style iron with an interior cavity at least partially occupied by an insert can be redistributed to the perimeter of the club head to increase MOI. In particular, redistributing the discretionary mass created by providing an insert occupying the interior cavity to the perimeter of the club head can increase Iyy by between 5% and 15%, relative to a similarly shaped blade-style club head. In some embodiments, the insert can increase Iyy by greater than 5%, greater than 6%, greater than 7%, greater than 8%, greater than 9%, greater than 10%, greater than 11%, greater than 12%, greater than 13%, greater than 14%, or greater than 15%, relative to a similarly shaped blade-style club head. As discussed above, the rear openings can provide a lower and more forward CG position. As such, the club head comprising a rear opening and an insert can improve both CG position and MOI, resulting in a combination of increased launch characteristics, forgiveness, and dispersion area.

In some embodiments, the insert can be injected in liquid form into the interior cavity through at least one of the rear openings or through a separate port. Once injected into the interior cavity, the liquid insert material will solidify, forming the insert. In some embodiments, once the desired amount of insert material has been injected, the insert exterior surface can be machined or otherwise finished to the desired geometry and left exposed. In other embodiments a badge (described in further detail below) may be placed over the rear opening and secured to the club head, covering the insert once it solidifies.

In other embodiments wherein the insert is exposed via the rear opening, the insert can be co-molded with the body. A negative mold can be placed over the rear wall. Once the negative mold is in place, the insert material can be injected into the interior cavity, filling the entire interior cavity. The negative mold prevents the insert material from overflowing out of the rear opening. Further, the negative mold allows the insert material to create a flush surface with the surface of the rear wall.

C. Badges

In some embodiments, rather than being exposed to the exterior of the club head, the insert can be covered by a badge. The badge can be coupled to the club head body to cover the one or more rear openings. The badge can be coupled to the body via epoxy adhesion, tape, mechanical means, or any other suitable joining method. The badge can partially or fully enclose the interior cavity, such that the insert is concealed within the interior cavity. In some embodiments, the badge completely conceals the insert within the interior cavity, such that the insert is not visible from the exterior of the club head. The badge can protect the insert from environmental damage. In doing so, covering the insert with a badge can allow the insert to be formed of a lower-density and/or lower-hardness material, thereby creating discretionary mass without sacrificing the durability of the insert. In some embodiments, the club head can comprise multiple badges. In some embodiments comprising multiple rear openings, separate badges can cover separate rear openings. In other embodiments, a single badge can cover multiple rear openings.

In some embodiments, the badge can be formed of a lightweight metal material, including, but not limited to, aluminum or an aluminum alloy. In other embodiments, the badge can comprise a lightweight polymer, a plastic material, or a composite material. In some embodiments, the badge is constructed from multiple materials. In some embodiments, the badge comprises a density less than the density of the club head body. Although the badge reintroduces mass to cover the one or more rear openings, covering said rear openings with a lightweight badge retains discretionary mass, because the mass of the badge is less than the removed rear wall mass.

II. Embodiments

A. Rear Opening in Upper Rear Wall

FIGS. 1-16 illustrate various embodiments of club heads 100, 200, 300, 400, 500, 600, 700, 800 comprising one or more rear openings and an insert that fully occupies the interior cavity. Providing an insert that fully occupies the interior cavity creates a club head with a multi-material, solid construction. In said multi-material solid construction, the club head is provided without any voids or empty space therein. As discussed above, a solid body construction (such as that of a blade-style iron) produces reduced vibrations at impact in comparison to the vibrations experienced by hollow-body or cavity-back irons, which comprise thin-walled bodies. The club head comprising an insert that fully occupies the interior cavity mimics the solid body construction of a blade-style iron yet provides increased discretionary mass by essentially replacing the core body material of a blade-style iron with a lightweight insert. Providing an insert that fully occupies the interior cavity provides maximum amounts of vibration damping while still creating discretionary mass relative to a solidly constructed iron.

FIGS. 1-7 illustrate a club head 100 comprising a rear opening 130 and an insert 140 that fully occupies the interior cavity 107. The club head 100 comprises a single rear opening 130 located within the upper rear wall 122. As illustrated in FIG. 5, the rear opening 130 is formed over a significant portion of the upper rear wall 122. The rear opening 130 can extend from the proximate the heel 104 to proximate the toe 106 and can further extend from proximate the inflection seam 125 to proximate the top rail 110.

As shown in FIG. 5, the rear opening 130 can comprise a substantially large exposure area. In some embodiments, the rear opening 130 can comprise an opening exposure area between 1.300 and 1.900 $in^2$. For example, the rear opening 130 can comprise an opening exposure area between 1.300 and 1.400 $in^2$, 1.400 and 1.500 $in^2$, 1.500 and 1.600 $in^2$, 1.600 and 1.700 $in^2$, 1.700 and 1.800 $in^2$, or between 1.800 and 1.900 $in^2$. In some embodiments, the rear opening 130 can have an opening exposure area greater than 1.30 $in^2$, 1.35 $in^2$, 1.40 $in^2$, 1.45 $in^2$, 1.50 $in^2$, 1.55 $in^2$, 1.60 $in^2$, 1.65 $in^2$, 1.70 $in^2$, 1.75 $in^2$, 1.80 $in^2$, or greater than 1.85 $in^2$. In some embodiments, the rear opening has an exposure area of approximately 1.593 $in^2$.

The rear opening 130 can cover a majority of the upper rear wall 122. In many embodiments, the rear opening 130 can comprise an opening exposure area between 60% and 95% of the upper rear wall surface area. In some embodiments, the rear opening 130 can form between 60% and 70%, 70% and 80%, or between 80% and 95% of the upper rear wall. In some embodiments, the rear opening 130 forms about 81.2% of the upper rear wall area.

The rear opening 130 can comprise a large exposure area relative to the entire rear wall 116. In many embodiments, the rear opening 130 can comprise an opening exposure area between 20% and 50% of the entire rear wall 116 surface area. In some embodiments, the rear opening 130 can form between 20% and 25%, 25% and 30%, 30% and 35%, 35% and 40%, 40% and 45%, or between 45% and 50% of the entire rear wall 116 surface area. For example, in some embodiments, the rear opening 130 forms about 35% of the entire rear wall 116 surface area.

As shown in FIGS. 5-7, the club head 100 does not comprise an opening in the lower rear wall 124. The club head 100 provides a low CG height, because the rear opening 130 removes mass from the upper rear wall 122, while no mass is removed from the lower rear wall 124. In some embodiments, the club head 100 can comprise a CG ground height between 0.25 inch and 0.35 inch, between 0.35 inch and 0.45 inch, between 0.45 inch and 0.55 inch, between 0.55 inch and 0.65 inch, or between 0.65 inch and 0.75 inch. In some embodiments, the club head can comprise a CG ground height can be less than 0.75 inch, less than 0.65 inch, less than 0.55 inch, less than 0.45 inch, less than 0.35 inch, or less than 0.25 inch.

As discussed above, the club head 100 comprises an insert 140 that fully occupies the interior cavity 107. As illustrated in FIG. 7, the insert 140 extends from the strike face 102 to the rear wall 116 and from the sole 112 to the top rail 110. The insert 140 comprises a complementary geometry to the interior cavity 107, such that no voids are formed between the insert 140 and the club head body 101. Further, an upper portion of the insert 140 extends through and fills the rear opening 130. The insert 140 comprises an insert exterior surface 145 that is exposed through the rear opening 130, such that the insert exterior surface 145 forms a portion of the club head rear surface. In some embodiments, the insert exterior surface 145 can be substantially flush with the upper rear wall 122, providing the appearance of a continuous rear wall 116. In doing so, the insert 140 provides a multi-material, solid club head construction that mimics the solid body construction of a blade-style iron, yet creates additional discretionary mass.

In some embodiments, the insert 140 forms a substantial portion of the club head rear surface 116 within the bounds of the upper rear wall 122. In many embodiments, the insert 140 comprises an insert exposure area between 1.300 and 1.900 int. For example, the insert exposure area can comprise an area between 1.300 and 1.400 $in^2$, 1.400 and 1.500 $in^2$, 1.500 and 1.600 $in^2$, 1.600 and 1.700 $in^2$, 1.700 and 1.800 $in^2$, or between 1.800 and 1.900 $in^2$. In some embodiments, the insert 140 has an exposure area of approximately 1.593 $in^2$.

Further, the insert 140 can form a substantial portion of the entire club head rear surface. As such, the insert 140 can comprise a large insert exposure area relative to the entire rear wall 116. In many embodiments, the insert 140 can comprise an insert exposure area between 20% and 50% of the entire rear wall 116 surface area. In some embodiments, the rear opening 130 can form between 20% and 25%, 25% and 30%, 30% and 35%, 35% and 40%, 40% and 45%, or between 45% and 50% of the entire rear wall 116 surface area. For example, in some embodiments, the rear opening 130 forms about 35% of the entire rear wall 116 surface area.

The insert 140 can be formed of a relatively hard insert material to enable a high insert exposure area without compromising the durability of the insert 140. In some embodiments, the insert 140 can comprise a hardness greater than Shore A60, greater than Shore A70, greater than Shore A80, greater than Shore A90, greater than Shore D40, greater than Shore D50, greater than Shore D60, greater than Shore D70, or greater than Shore D80. Providing a high hardness (greater than Shore A60) protects the exposed insert exterior surface 145 from being damaged during use.

B. Rear Opening in Upper Rear Wall and Badge

Figure 8:
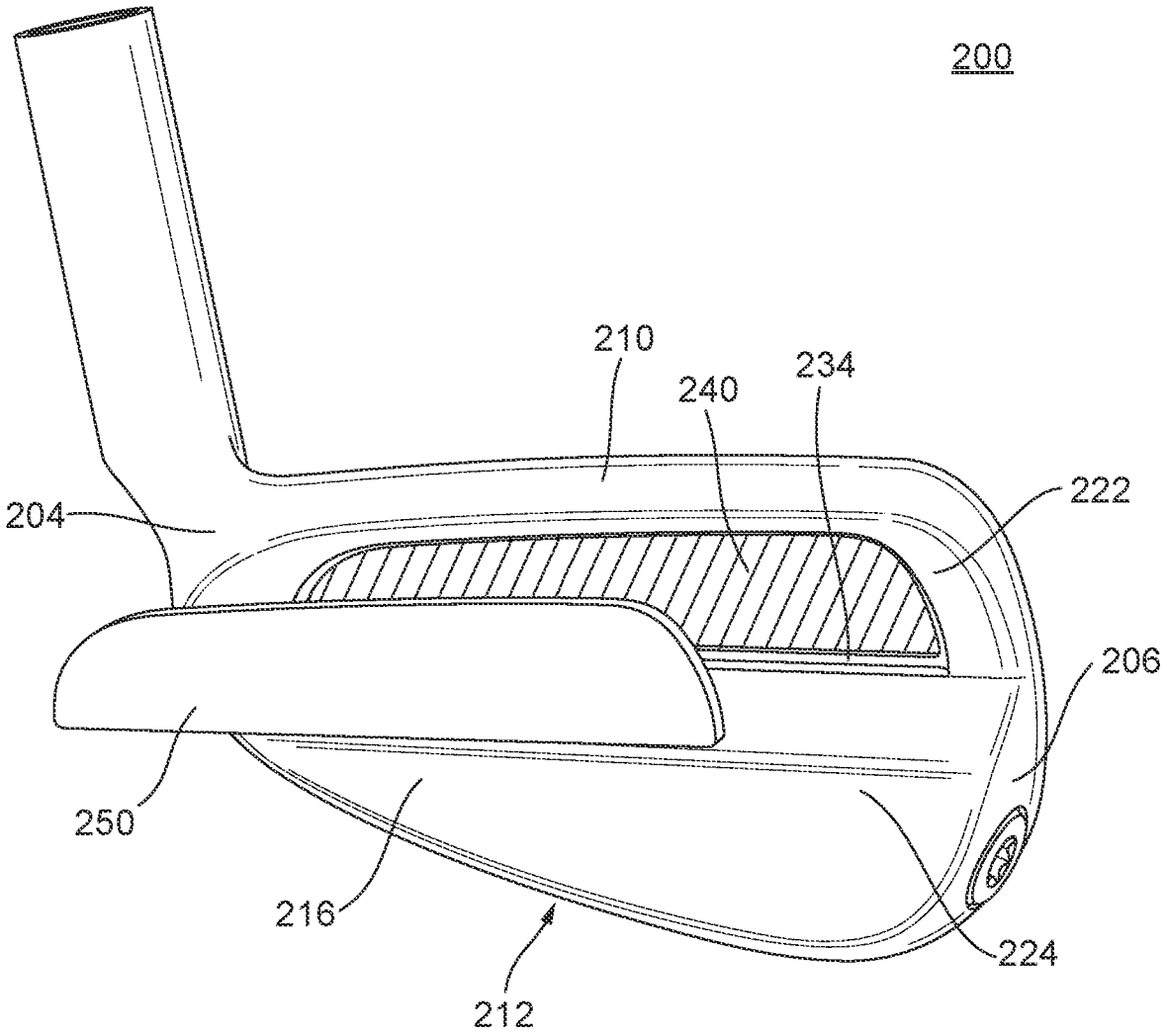
FIG. 8 illustrates a rear view of the golf club head of FIG. 1.
Figure 9:
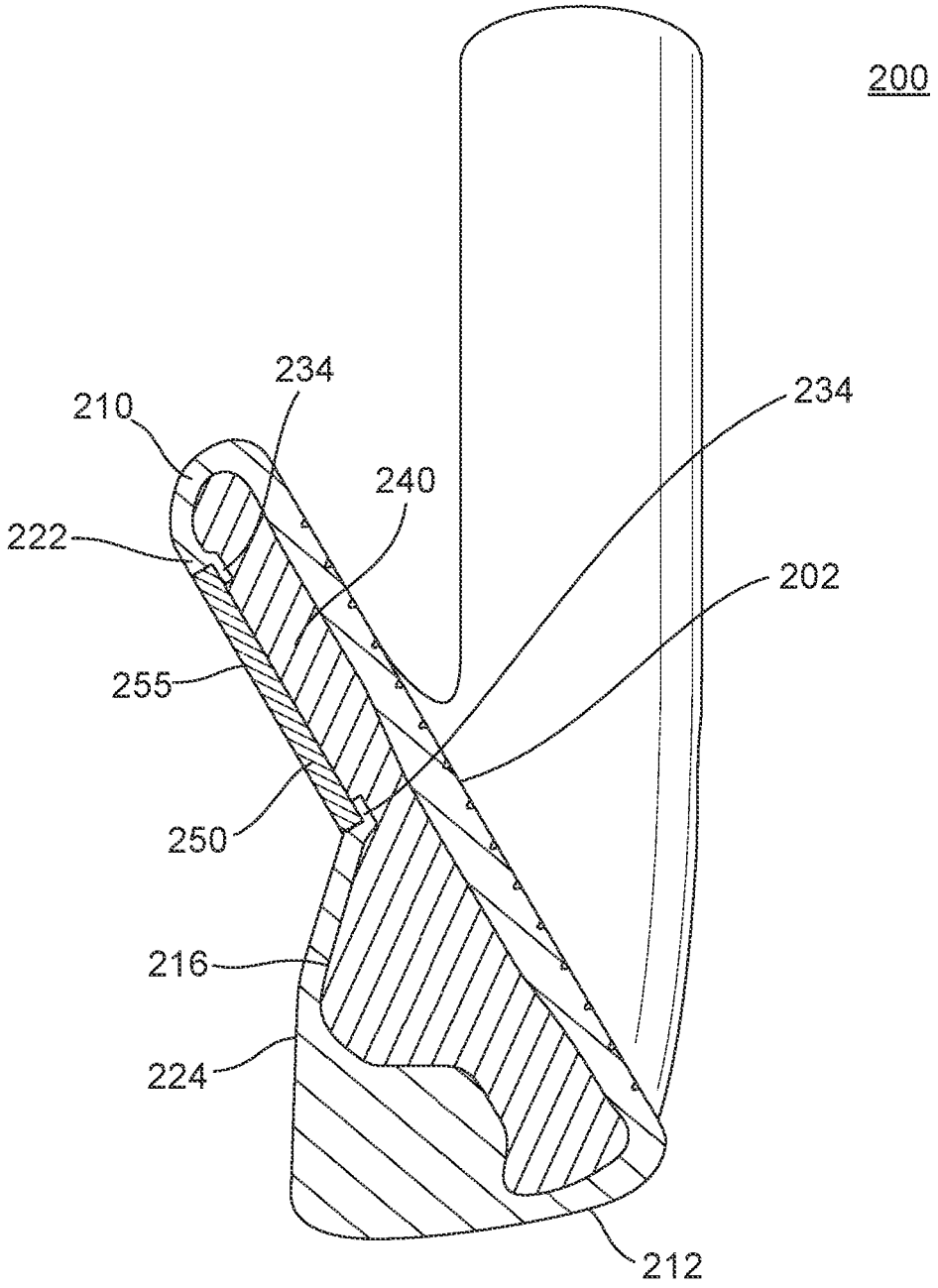
FIG. 9 illustrates a toe-side cross-sectional view of a golf club head comprising a rear opening, an insert, and a badge.

FIGS. 8 and 9 illustrate a club head 200 comprising a rear opening 240 in the upper rear wall 222. Club head 200 can be substantially similar to club head 100, other than that club head 200 comprises a badge 250 that covers the rear opening 230 and conceals the insert 240 within the interior cavity 207. The badge 250 protects the insert 240, allowing the insert 240 to be formed of material with a lower hardness (i.e., less than Shore A60) and a lower density (i.e., less than 1.5 g/cm$^3$), thereby increasing discretionary mass.

Rather than the insert 240 extending through the rear opening 230, the club head 200 comprises a badge 250 that is placed within the rear opening 230, closing and/or sealing the rear opening 230. Referring to FIGS. 8 and 9, a recessed ledge 234 circumscribes the rear opening 230. The recessed ledge 234 extends from the upper rear wall 222 into the rear opening 230 and provides a surface to couple the badge 250 thereto. Referring to FIG. 1, the insert exterior surface 245 is inset from the upper rear wall 222, thereby allowing the badge exterior surface 255 to be flush with the upper rear wall 222. The insert exterior surface 245 can be flush with the recessed ledge, such that the badge 250 can sit flush against the insert exterior surface 245.

The badge 250 protects the insert 240 during use. The insert 240 can therefore be formed of a material with a lower hardness and/or a lower density than insert 140, which is exposed to the exterior of the club head 200. In some embodiments, the insert 240 can comprise a hardness between less than Shore A60, less than Shore A50, less than Shore A40, less than Shore A30, less than Shore A20, or less than Shore A10.

C. Heel-side Rear Opening in Upper Rear Wall

Figure 10:
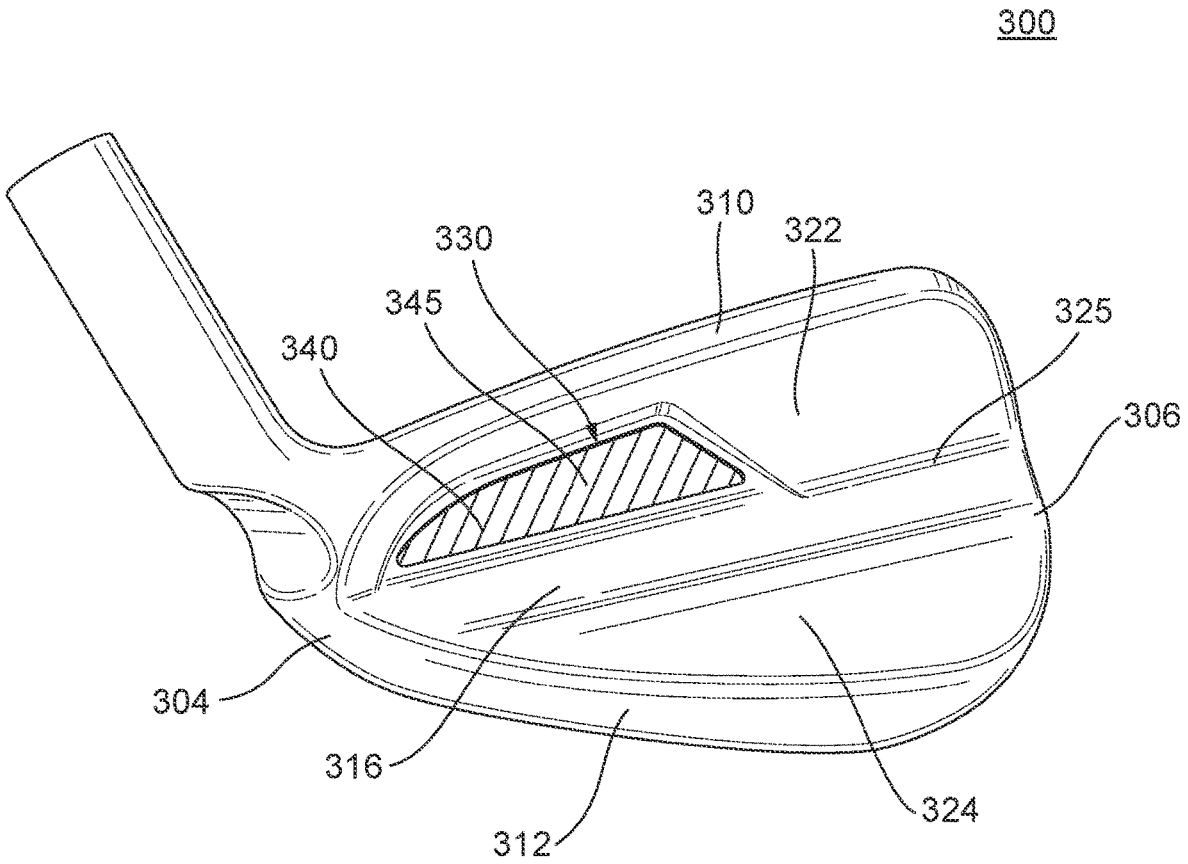
FIG. 10 illustrates a rear perspective view of a golf club head comprising a heel-side rear opening and an insert.

FIG. 10 illustrates a club head 300 that is similar to the club head 100 and 200 described above, in that the club head 300 comprises a heel-side rear opening 330 and an insert 340. The club head 300 is different from club heads 100 and 200 in that the heel-side rear opening 330 is located substantially in the heel. Specifically, the heel-side rear opening 330 is formed in the majority of a heel-ward portion of the upper rear wall 322 but does not extend into the toe-ward portion of the upper rear wall 322. The heel-side rear opening 340 removes mass from the heel end 304 of the club head 300 and allows more mass to be placed in the toe end 306 of the club head 300. This arrangement of mass can move the CG position more toe-ward to provide a draw-biased shot shape. The heel-side rear opening 340 also improves MOI and maintaining a low CG position by removing mass from an upper portion of the club head 300 and creating discretionary mass.

As shown in FIG. 10, the rear opening 340 can comprise an opening exposure area between 0.75 and 1.50 in$^2$. For example, the exposure area can comprise an area between 0.75 and 0.85 in$^2$, 0.85 and 0.95 in$^2$, 0.95 and 1.05 in$^2$, 1.05 and 1.15 in$^2$, 1.15 and 1.25 in$^2$, or between 1.25 and 1.50 in$^2$. In some embodiments, the rear opening 340 has an exposure area of approximately 0.81 in$^2$.

As shown in FIG. 10, the rear opening 330 can comprise an exposure area between 30% and 80% of the upper rear wall surface area. In some embodiments, the rear opening 330 can form between 30% and 45%, 45% and 65%, or between 65% and 80% of the upper rear wall. In some embodiments, the rear opening 330 forms about 43% of the upper rear wall area.

As described above, the club head 300 further comprises an insert 340 that fully occupies the interior cavity 307. The insert 340 comprises a complementary geometry to the interior cavity walls such that no voids are formed between the insert 340 and club head body 301. The insert 340 comprises an insert exterior surface 345 that is exposed through the rear opening 340 such that the insert 340 forms a portion of the club head rear surface. Specifically, the insert 340 forms a portion of the club head rear surface proximate the heel 304 and does not form any portion of the club head rear surface proximate the toe 306. In doing so, the insert 340 provides a multi-material, solid club head construction that mimics the solid construction of a blade-style iron yet creates additional discretionary mass.

D. Heel-side and Toe-side Rear Openings in Upper Rear Wall

Figure 11:
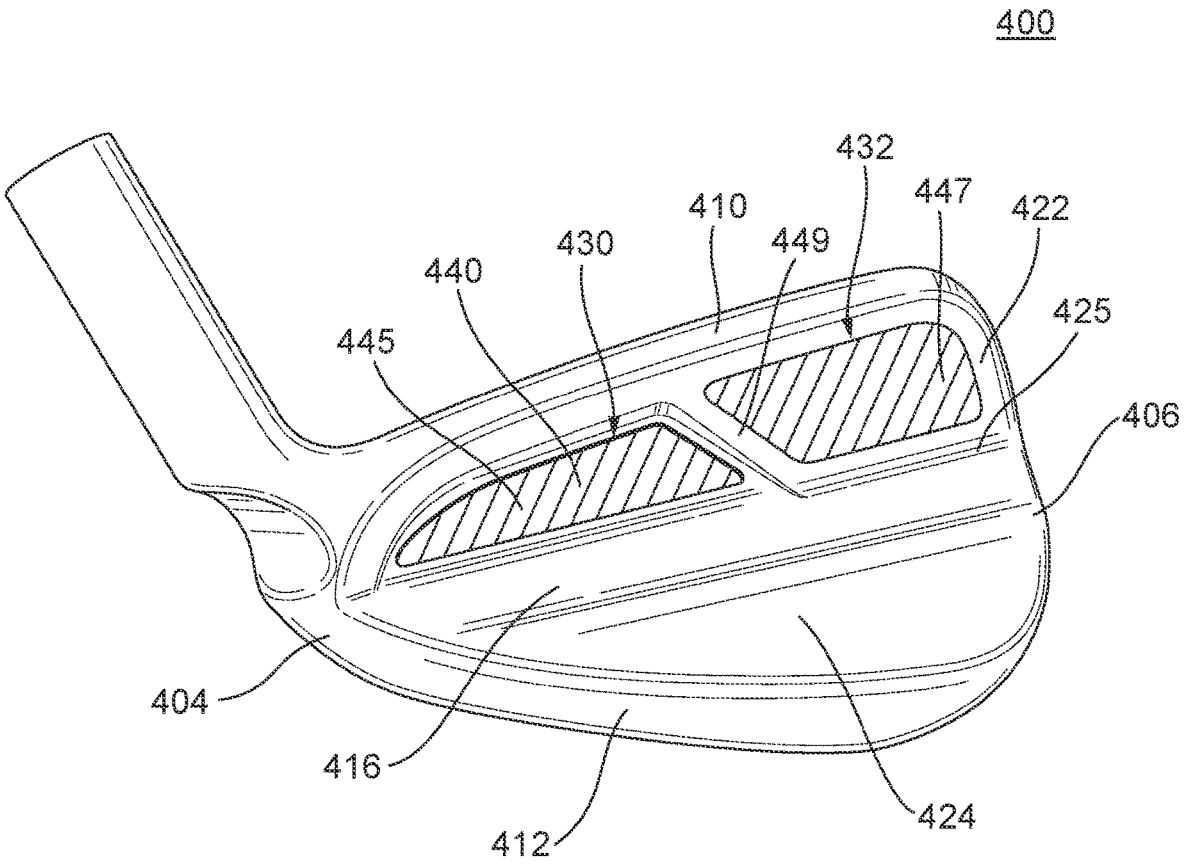
FIG. 11 illustrates a rear perspective view of a golf club head comprising a heel-side rear opening, a toe-side rear opening, and an insert.

FIG. 11 illustrates a club head 400 that is similar to club heads 100, 200, and 300 described above, in that the club head 400 comprises at least one rear opening and an insert. The club head 400 is different than club heads 100, 200 and 300 in that club head 400 comprises two rear openings. Specifically, the club head 400 comprises a heel-side upper opening 430 and a toe-side upper opening 432. The heel-side upper opening 430 and the toe-side upper opening 432 are located on the upper rear wall 422, above the inflection seam 425 and below the top rail 410. The heel-side upper opening 430 and the toe-side upper opening 432 are separated by a dividing bar 449 which extends from the inflection seam 425 towards the top rail 410. The dividing bar 449 can be the same material as the rest of the club head body 400. The club head 400 comprising a heel-side upper opening 430 and a toe-side upper opening 432 can provide small adjustments to CG and mass properties, relative to the other embodiments described herein, to achieve a desired performance and shot shape.

As shown in FIG. 11, the heel-side upper opening 430 comprises an opening exposure area ranging between 0.75 and 1.50 in$^2$. For example, the exposure area can comprise an area between 0.75 and 0.85 in$^2$, 0.85 and 0.95 in$^2$, 0.95 and 1.05 in$^2$, 1.05 and 1.15 in$^2$, 1.15 and 1.25 in$^2$, or between 1.25 and 1.50 in$^2$. In some embodiments, the rear opening 340 has an exposure area of approximately 0.81 in$^2$.

As shown in FIG. 11, the toe-side upper opening 432 comprises an opening exposure area ranging between 0.75 and 1.50 in$^2$. For example, the exposure area can comprise an area between 0.75 and 0.85 in$^2$, 0.85 and 0.95 in$^2$, 0.95 and 1.05 in$^2$, 1.05 and 1.15 in$^2$, 1.15 and 1.25 in$^2$, or between 1.25 and 1.50 in$^2$. In some embodiments, the rear opening 340 has an exposure area of approximately 0.89 in$^2$.

Together, the heel-side upper opening 430 and toe-side upper opening 432 can have a combined opening exposure area ranging from 1.300 and 1.900 in$^2$. For example, the combined exposure area can be between 1.300 and 1.400 in$^2$, 1.400 and 1.500 in$^2$, 1.500 and 1.600 in$^2$, 1.600 and 1.700 in$^2$, 1.700 and 1.800 in$^2$, or between 1.800 and 1.900 in$^2$. In some embodiments, the combined exposure area is approximately 1.45 in$^2$.

The heel-side upper opening 430 and toe-side upper opening 432 can comprise a combined opening exposure area between 20% and 50% of the entire rear wall 416 surface area. In some embodiments, heel-side upper opening 430 and toe-side upper opening 432 form between 20% and 25%, 25% and 30%, 30% and 35%, 35% and 40%, 40% and 45%, or between 45% and 50% of the entire rear wall 416 surface area. For example, in some embodiments, the heel-side upper opening 430 and toe-side upper opening 432 form about 35% of the entire rear wall 416 surface area.

The dividing bar 449 comprises a width, measured in an approximately heel-toe direction. The dividing bar 449 width can range from 0.05 inch to 0.20 inch. In some embodiments, the dividing bar 449 can have a width ranging between 0.05 and 0.10 inch, 0.10 and 0.15 inch, or 0.15 and 0.20 inch. In some embodiments, the dividing bar 449 has a width of approximately 0.11 inch.

The club head 400 further comprises an insert 440 that fully occupies the interior cavity 407 and is exposed through the heel-side upper opening 430 and the toe-side upper opening 432. Further, the insert 440 comprises a heels-side exterior surface 445 and a toe-side exterior surface 447 which each form a portion of the club head rear surface. In the illustrated embodiment, the dividing bar 449 is flush with the toe-side insert exterior surface 447 while being offset from the heel-side insert exterior surface 445. In the illustrated embodiment, the heel-side insert exterior surface 445 is recessed inwardly from the dividing bar 449. This arrangement of surfaces around the dividing bar achieves a unique and aesthetically pleasing appearance while simultaneous providing a multi-material, solid club head construction that mimics the solid construction of a blade-style iron yet creates additional discretionary mass.

E. Heel-side, Toe-side, and Central Rear Openings in Upper Rear Wall

Figure 12:
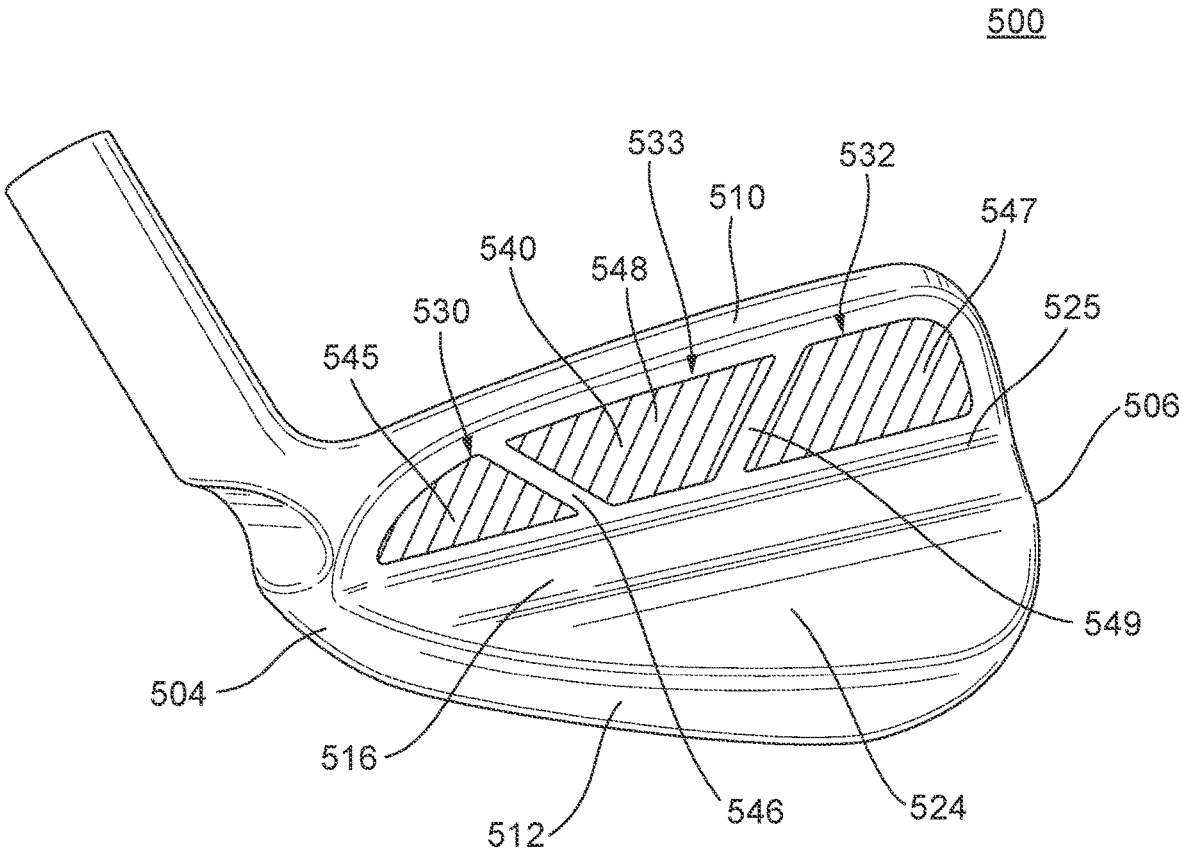
FIG. 12 illustrates a rear perspective view of a golf club head comprising a heel-side rear opening, a toe-side rear opening, a central opening, and an insert.

FIG. 12 illustrates a club head 500 that is similar to club head 400 described above, in that the club head 500 comprises multiple rear openings and an insert 540. The club head 500 is different from club head 400 in that the club head 500 comprises three rear openings. Specifically, the club head 500 comprises a heel-side upper opening 530, a toe-side upper opening 532, and a central opening 533. The heel-side upper opening 530, the toe-side upper opening 532, and the central opening 533 are each located on the upper rear wall 522, above the inflection seam 525 and below the top rail 510. The heel-side upper opening 530 is located heel-ward of the central opening 533 and is separated from the central opening 533 by a heel-side dividing bar 546. Similarly, the toe-side upper opening 530 is located toe-ward of the central opening 533 and is separated from the central opening 533 by a toe-side dividing bar 549. The dividing bars 546, 549 each extend from the inflection seam 525 toward the top rail 510. The dividing bars 546, 549 form a portion of the upper rear wall 522.

As shown in FIG. 12, the central opening 533 and toe-side opening 532 have a larger exposure area than the heel-side opening 530. The central opening 533 has a larger exposure area than then toe-side opening 532. In other embodiments, the relative exposure areas of the openings 530, 532, 533 may be different. For example, in some embodiments, the central opening 533 may have the smallest exposure area or the second smallest exposure area, compared to the other openings. In some embodiments, the heel-side opening 530 may have the largest exposure area or second largest exposure area, compared to the other openings. In some embodiments, the toe-side opening 532 may have the largest exposure area or smallest exposure area, compared to the other openings.

As shown in FIG. 12, the heel-side upper opening 530 comprises an opening exposure area ranging between 0.5 and 1.25 $in^2$. For example, the exposure area can comprise an area between 0.5 and 0.65 $in^2$, 0.65 and 0.85 $in^2$, 0.85 and 1.05 $in^2$, 1.05 and 1.15 $in^2$, or between 1.15 and 1.25 $in^2$. In some embodiments, the heel-side upper opening 530 has an exposure area of approximately 0.61 $in^2$.

As shown in FIG. 12, the toe-side upper opening 532 comprises an opening exposure area ranging between 0.5 and 1.25 $in^2$. For example, the exposure area can comprise an area between 0.5 and 0.65 $in^2$, 0.65 and 0.85 $in^2$, 0.85 and 1.05 $in^2$, 1.05 and 1.15 $in^2$, or between 1.15 and 1.25 $in^2$. In some embodiments, the toe-side upper opening 532 has an exposure area of approximately 0.88 $in^2$.

As shown in FIG. 12, the central opening 533 comprises an opening exposure area ranging between 0.5 and 1.25 $in^2$. For example, the exposure area can comprise an area between 0.5 and 0.65 $in^2$, 0.65 and 0.85 $in^2$, 0.85 and 1.05 $in^2$, 1.05 and 1.15 $in^2$, or between 1.15 and 1.25 $in^2$. In some embodiments, the central opening 533 has an exposure area of approximately 0.95 $in^2$.

Together, the heel-side upper opening 530, toe-side upper opening 532, and central opening 533 can have a combined opening exposure area ranging from 1.300 and 1.900 $in^2$. For example, the openings can comprise an area between 1.300 and 1.400 $in^2$, 1.400 and 1.500 $in^2$, 1.500 and 1.600 $in^2$, 1.600 and 1.700 $in^2$, 1.700 and 1.800 $in^2$, or between 1.800 and 1.900 $in^2$. In some embodiments, the openings have an exposure area of approximately 1.42 $in^2$.

The heel-side and toe-side dividing bars 546, 549 comprise a width, measured in an approximately heel-toe direction. The dividing bars 546, 549 widths can range from 0.05 inch to 0.20 inch. In some embodiments, the dividing bars 546, 549 can have a width ranging between 0.05 and 0.10 inch, 0.10 and 0.15 inch, or 0.15 and 0.20 inch. In some embodiments, the dividing bars 546, 549 has a width of approximately 0.11 inch.

The club head 500 further comprises an insert 540 that fully occupies the interior cavity 507 and is exposed through the heel-side upper opening 530, toe-side upper opening 532, and central opening 533. Further, the insert 540 comprises a plurality of exterior surfaces which each form a portion of the club head rear surface. The insert 540 defines a heel-side exterior surface 545 exposed through the heel-side upper opening 530, a toe-side exterior surface 547 exposed through the toe-side upper opening 532, and a central exterior surface 548 exposed through the central opening 533. The heel-side exterior surface 545 forms a portion of the club head rear surface in the upper rear wall 522, proximate the heel 504. The toe-side exterior surface 547 forms a portion of the club head rear surface in the upper rear wall 522, proximate the toe 506. The central exterior surface 548 forms a portion of the club head rear surface in the upper rear wall 522, in between the heel-side exterior surface 545 and the toe-side exterior surface 547. The insert exterior surfaces 545, 547, 548 can each be flush with the dividing bars 546, 549 to form a continuous and smooth club head rear surface in the upper rear wall 522. In doing so, the insert 540 provides a multi-material, solid club head construction that mimics the solid construction of a blade-style iron yet creates additional discretionary mass.

F. Rear Opening in Lower Rear Wall

Figure 13:
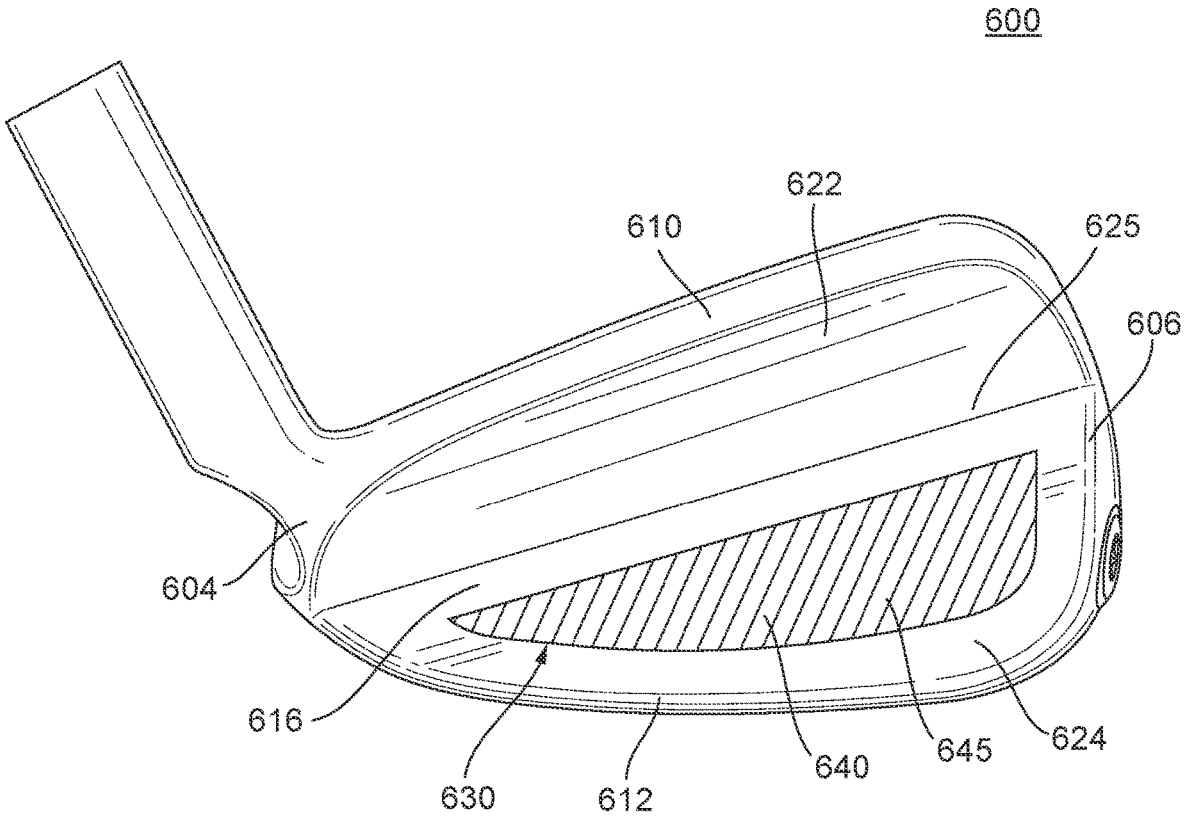
FIG. 13 illustrates a rear perspective view of a golf club head comprising a lower rear opening and an insert.

FIG. 13 illustrates a club head 600 that is similar to club heads 100, 200, 300, 400, 500 described above, in that the club head 600 comprises a rear opening and an insert. The club head 600 is different than club heads 100, 200, 300, 400, 500 in that the club head 600 comprises a lower rear opening 630 instead of an upper rear opening. The lower rear opening 630 is located below the inflection seam 625, in the bottom half of the club head 600. The lower rear opening 630 can improve discretionary mass and mass properties to adjust club head performance by removing high-density body material and replacing it with lower-density insert material.

The lower rear opening 630 comprises an opening exposure area ranging from about 1.300 and 1.900 $in^2$. For example, the lower rear opening 630 can comprise an opening exposure area between 1.300 and 1.400 $in^2$, 1.400 and 1.500 $in^2$, 1.500 and 1.600 $in^2$, 1.600 and 1.700 $in^2$, 1.700 and 1.800 $in^2$, or between 1.800 and 1.900 $in^2$. In some embodiments, the rear opening has an exposure area of approximately 1.620 $in^2$.

The lower rear opening 630 comprises an opening exposure area ranging from 20% and 50% of the entire rear wall 616 surface area. In some embodiments, the lower rear opening 630 can form between 20% and 25%, 25% and 30%, 30% and 35%, 35% and 40%, 40% and 45%, or between 45% and 50% of the entire rear wall 616 surface area. For example, in some embodiments, the lower rear opening 630 forms about 39% of the entire rear wall 616 surface area.

The club head 600 further comprises an insert 640 that fully occupies the interior cavity 607 and is exposed through the lower rear opening 630. Further, the insert 640 comprises an insert exterior surface 645, which forms a portion of the club head rear surface. Specifically, the insert 640 forms a portion of the lower rear wall 624. The insert rear surface is flush with the lower rear wall 624 to form a continuous and smooth exterior surface. In doing so, the insert 640 provides a multi-material, solid club head construction that mimics the solid construction of a blade-style iron yet creates additional discretionary mass.

G. Rear Openings in Upper Rear Wall and Lower Rear Wall

Figure 14:
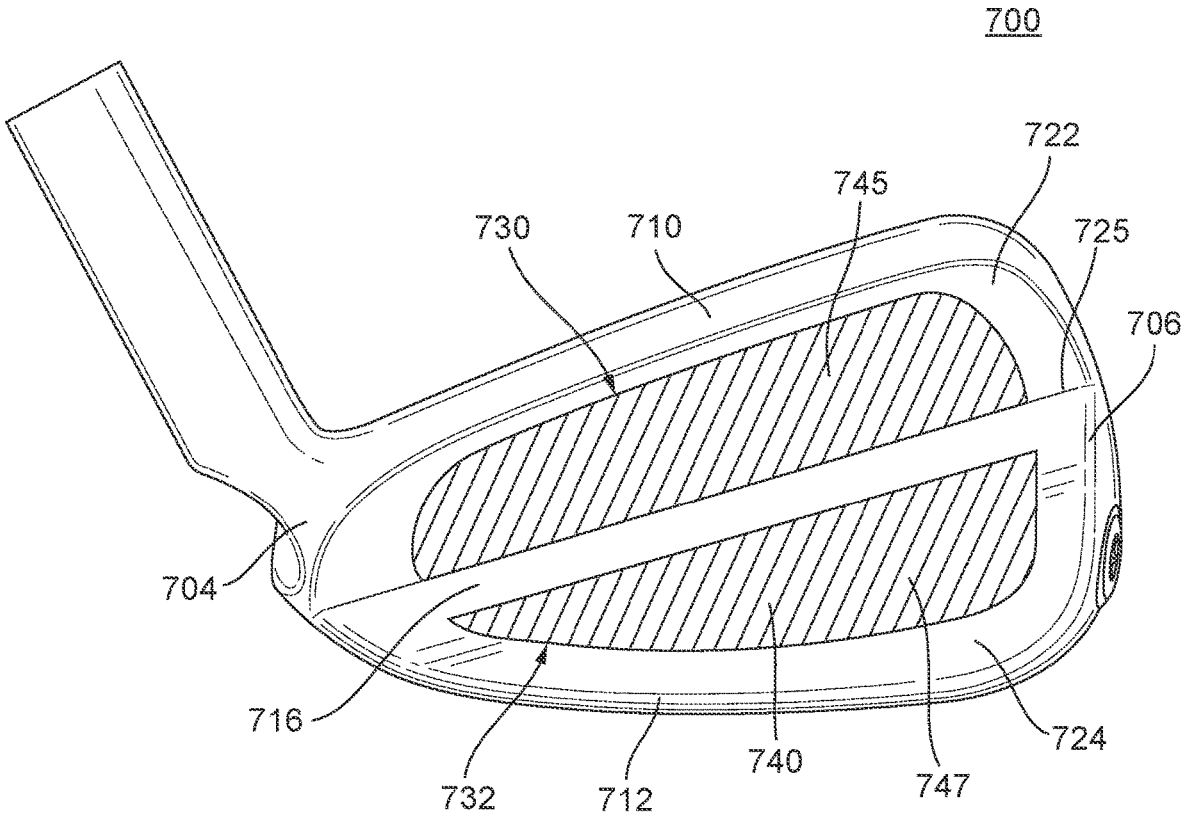
FIG. 14 illustrates a rear perspective view of a golf club head comprising an upper rear opening, a lower rear opening, and an insert.
Figure 15:
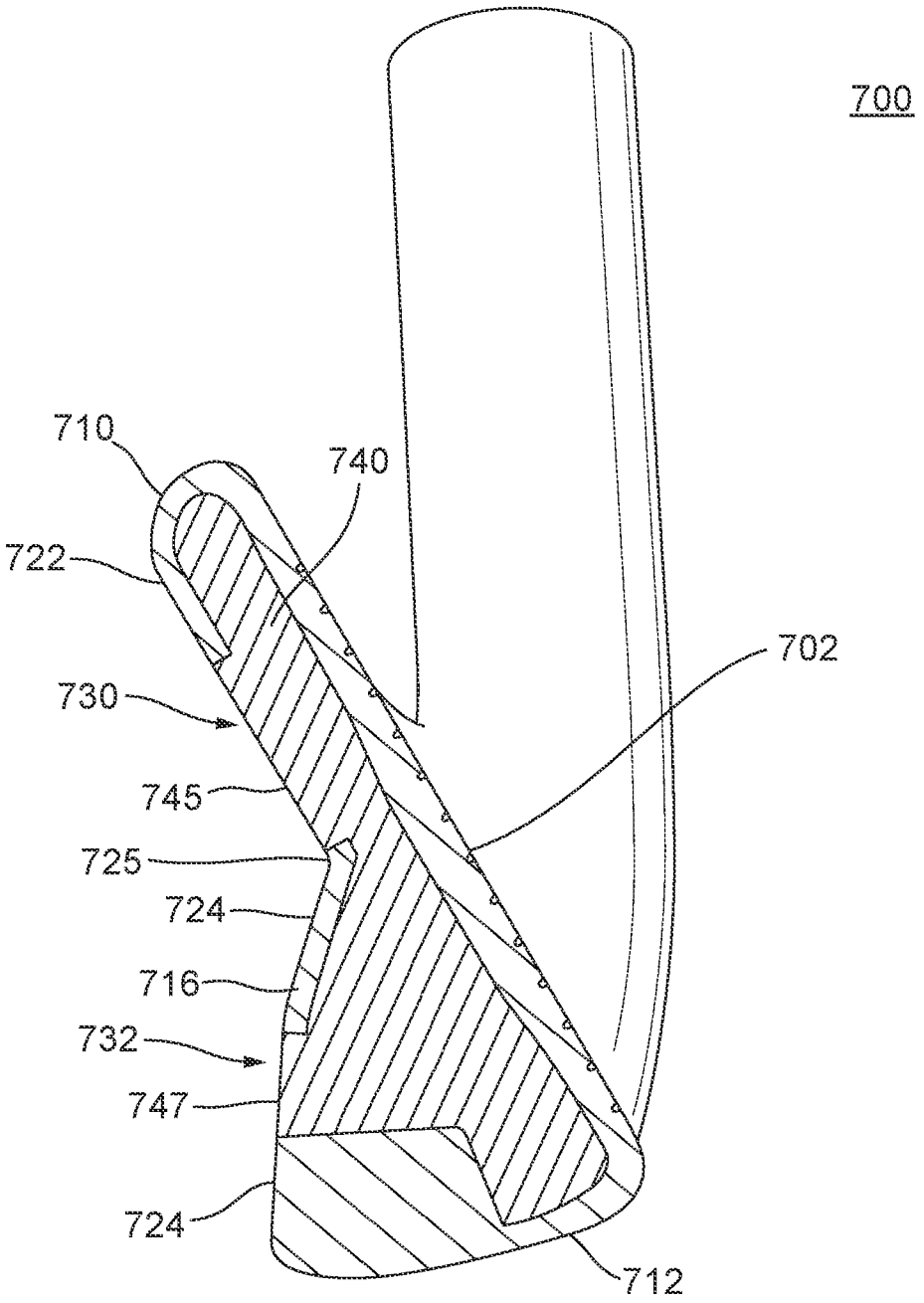
FIG. 15 illustrates a toe-side cross-sectional view of the golf club head of FIG. 14.

FIGS. 14 and 15 illustrate a club head 700 that is similar to club heads 100-600 described above, in that the club head 700 comprises a rear opening and an insert. The club head 700 is different than the club heads 100-600 in that the club head 700 comprises an upper rear opening 730 and a lower rear opening 732. The inflection seam 725 separates the upper opening 730 from the lower opening 732 such that the upper opening 730 is located above the inflection seam 725 and the lower opening 732 is located below the inflection seam 725.

The upper rear opening 730 comprises an opening exposure area ranging from about 1.300 and 1.900 $in^2$. For example, the upper rear opening 730 can comprise an opening exposure area between 1.300 and 1.400 $in^2$, 1.400 and 1.500 $in^2$, 1.500 and 1.600 $in^2$, 1.600 and 1.700 $in^2$, 1.700 and 1.800 $in^2$, or between 1.800 and 1.900 $in^2$. In some embodiments, the rear opening has an exposure area of approximately 1.593 $in^2$.

The lower rear opening 732 comprises an opening exposure area ranging from 1.300 and 1.400 $in^2$, 1.400 and 1.500 $in^2$, 1.500 and 1.600 $in^2$, 1.600 and 1.700 $in^2$, 1.700 and 1.800 $in^2$, or between 1.800 and 1.900 $in^2$. In some embodiments, the lower rear opening 730 has an exposure area of approximately 1.620 $in^2$.

Combined, the upper rear opening 730 and lower rear opening 732 comprise an opening exposure area ranging 2.00 to 4.00 $in^2$. In some embodiments, the combined exposure area can range from 2.00 and 2.25 $in^2$, 2.25 and 2.50 $in^2$, 2.50 and 2.75 $in^2$, 2.75 and 3.00 $in^2$, 3.00 and 3.25 $in^2$, 3.25 and 3.50 $in^2$, 3.50 and 3.75 $in^2$, or between 3.75 and 4.00 $in^2$. In some embodiments, the lower rear opening 730 has an exposure area of approximately 3.12 $in^2$.

Combined, the upper rear opening 730 and lower rear opening 732 form 60% and 95% of the total rear wall surface area. In some embodiments, the upper rear opening 730 and lower rear opening 732 can form between 60% and 70%, 70% and 80%, or between 80% and 95% of the total rear wall area. In some embodiments, the upper rear opening 730 and lower rear opening 732 forms about 81.2% of the total rear wall area.

The club head 700 further comprises an insert 740 that fully occupies the interior cavity 707 and is exposed through the lower rear opening 732 and upper rear opening 730. Further, the insert 740 comprises an upper insert exterior surface 745 and a lower insert exterior surface 747 which each form a portion of the club head rear wall 716. The upper insert exterior surface 745 is flush with the upper rear wall 722 and the lower insert exterior surface 747 is flush with the lower rear wall 724 to form a continuous and smooth club head rear surface. In doing so, the insert 740 provides a multi-material, solid club head construction that mimics the solid construction of a blade-style iron yet creates additional discretionary mass.

H. Rear Openings in Upper Rear Wall and Lower Rear Wall with Badge

Figure 16:
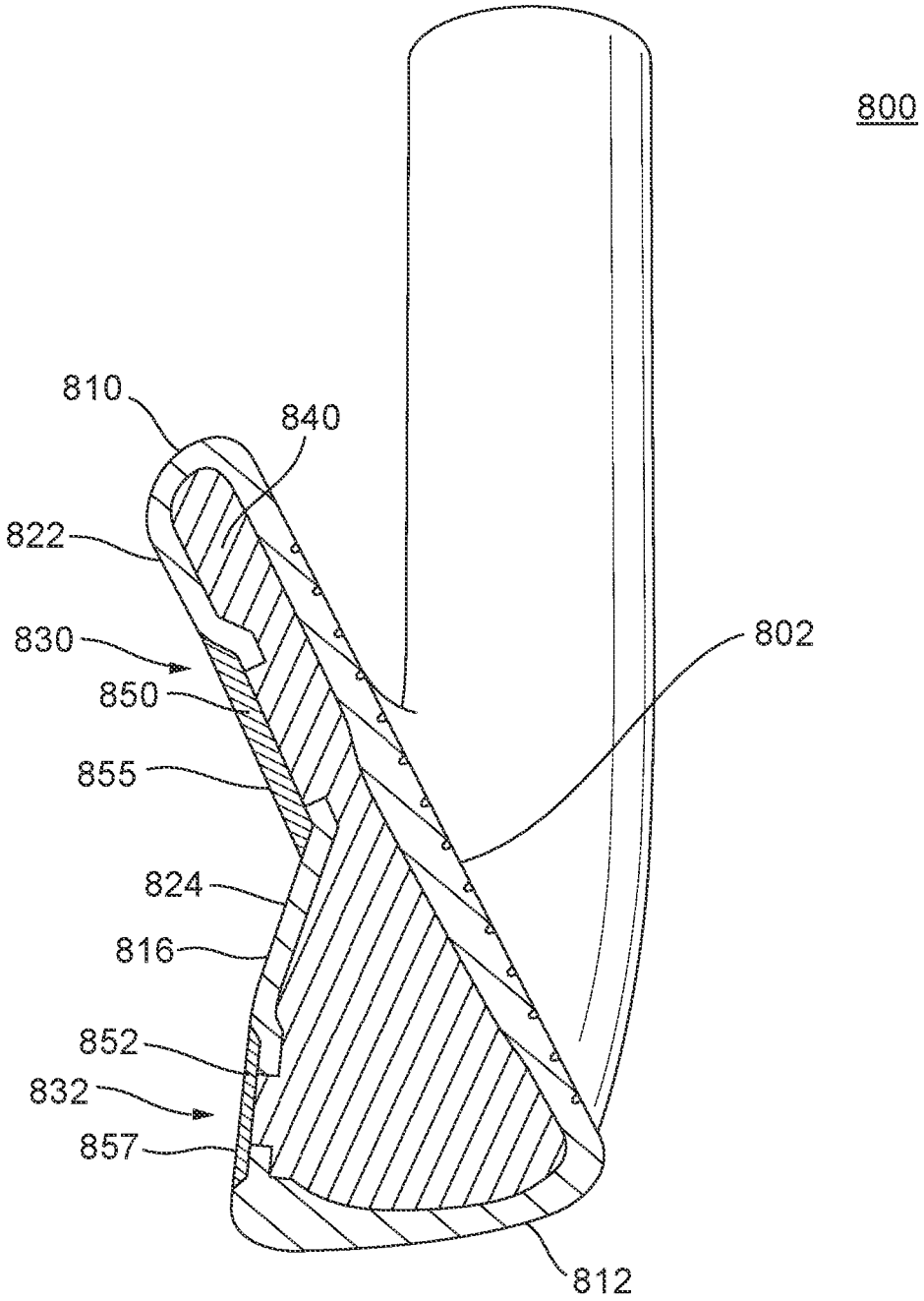
FIG. 16 illustrates a toe-side cross-sectional view a golf club head comprising an upper rear opening, a lower rear opening, an upper badge, a lower badge, and an insert.

FIG. 16 illustrates a club head 800 that is similar to the club head 700, in that the club head 800 comprises an upper rear opening 830 and lower rear opening 832. The club head 800 is different than club head 700 in that the club head 800 further comprises an upper badge 850 and lower badge 852 to cover the upper rear opening 830 and lower rear opening 832, respectively. The badges 850, 852 protect the insert 840, allowing the insert 840 to be formed of a material with a lower hardness and/or a lower density without sacrificing the durability of the insert 840, thereby increasing discretionary mass.

The upper rear opening 830 and lower rear opening 832 comprise a recessed ledge in which the upper badge 850 and lower badge 852 are coupled too. The recessed ledge circumscribes each opening 830, 832. The recessed ledges allows the badges 850, 852 to lay flush with the upper rear wall 822 and lower rear wall 824, forming a continuous and smooth rear exterior surface. Furthermore, the upper badge 850 and lower badge 852 can lay flush against the insert 840.

I. Upper Rear Opening with Localized Insert

FIGS. 17-21 illustrate various club heads 900, 1100, 1200 comprising one or more rear openings and an insert that partially occupies the interior cavity. Rather than an embodiment comprising an insert that fully occupies the interior cavity, providing an insert that only partially occupies the interior cavity creates a club head construction with one or more spaces or voids. The spaces or voids can be formed between the insert and the body, or within the insert itself. Inserts that partially occupy the interior cavity provide increased amounts of discretionary mass, while still providing high levels of vibration damping.

Figure 17:
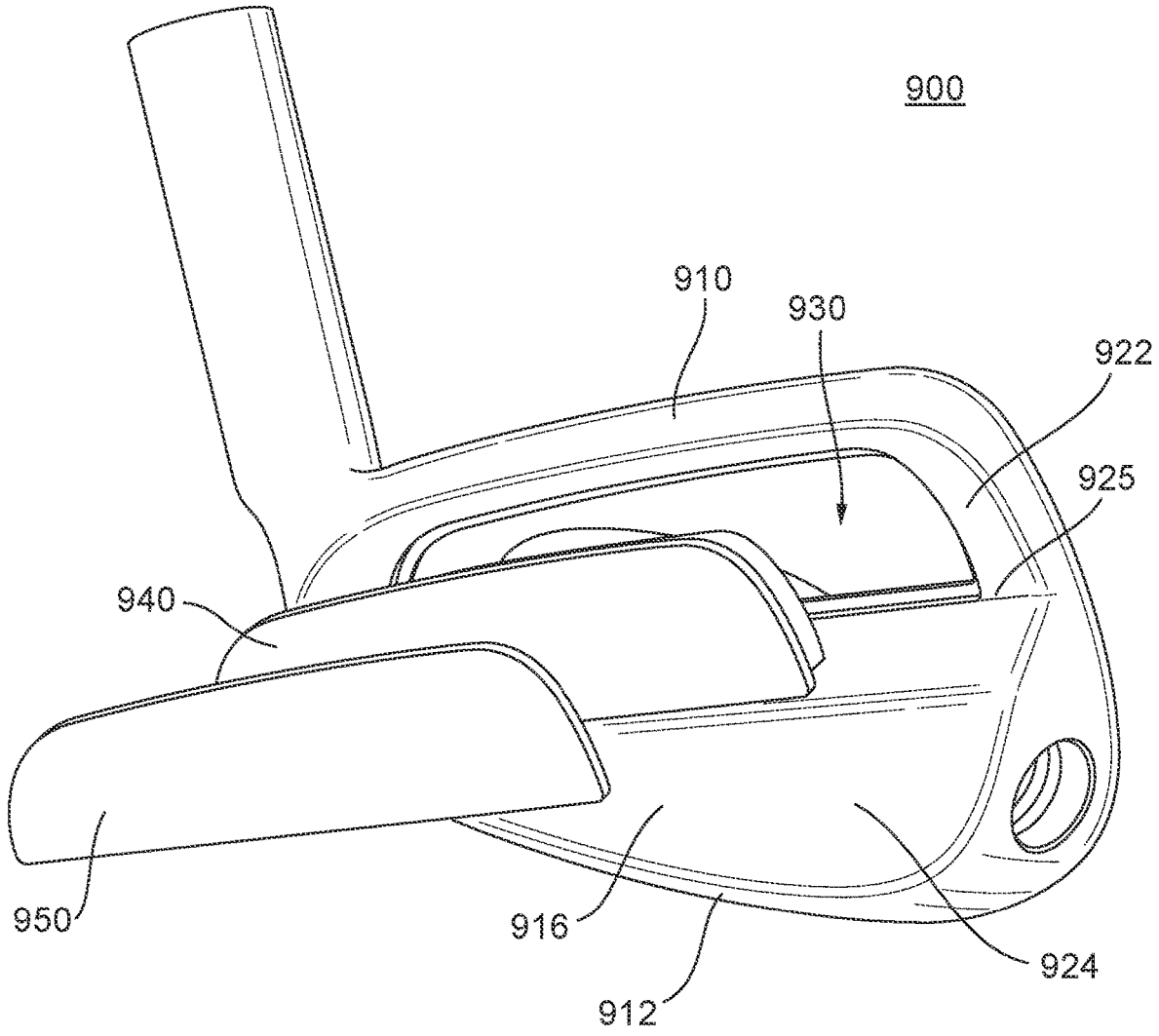
FIG. 17 illustrates a rear perspective view of a golf club head comprising an upper rear opening, a badge, and a localized insert.
Figure 18:
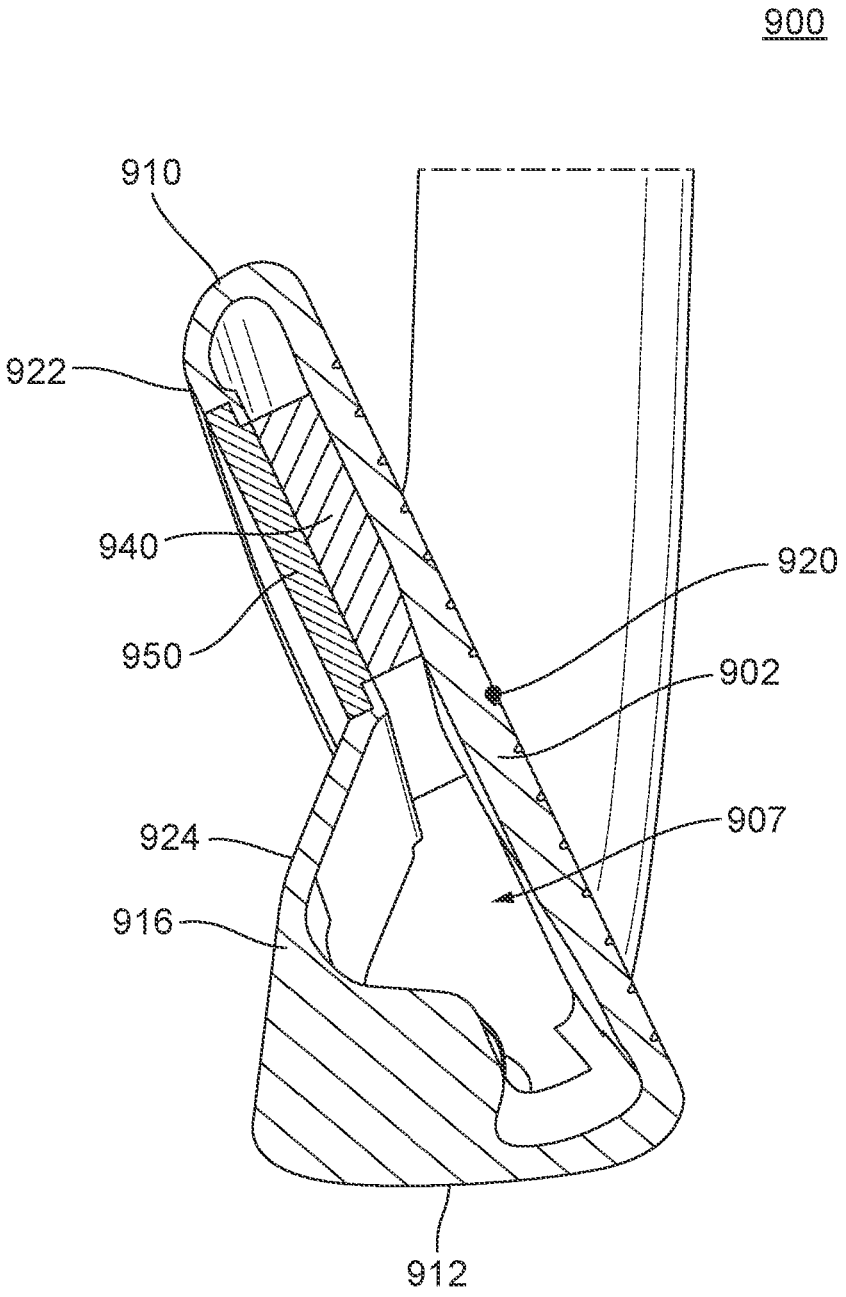
FIG. 18 illustrates a toe-side cross-sectional view of the golf club head of FIG. 17.
Figure 19:
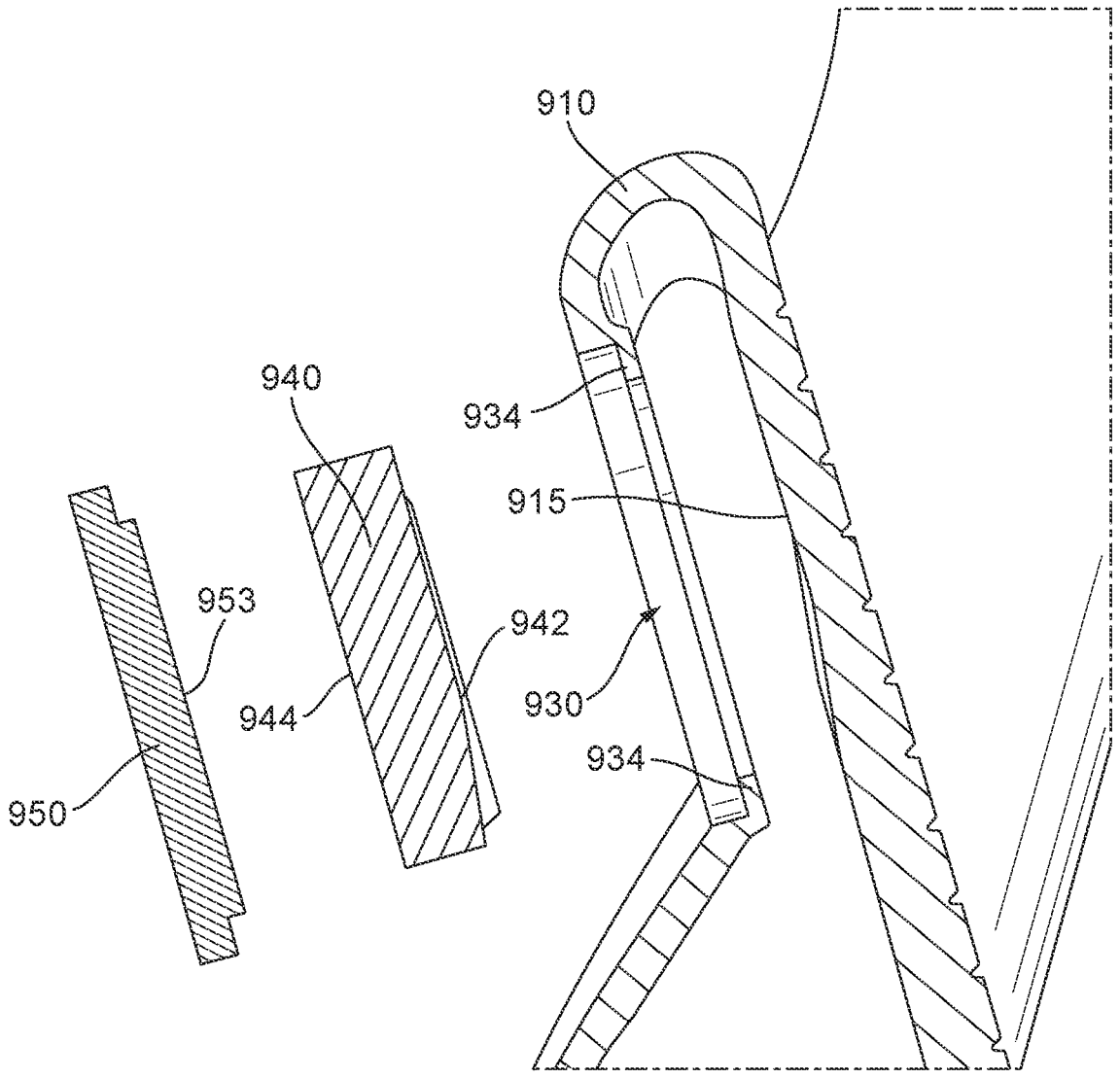
FIG. 19 illustrates a toe-side cross sectional exploded view of the golf club head of FIG. 17, detailing the badge and insert.

FIGS. 17-19 illustrate a club head 900 comprising a localized insert 940 that partially occupies the interior cavity 907. The localized insert 940 is configured to contact a specific portion of the club head body 901 to target areas of dominant vibrations. The localized insert 940 efficiently damps said dominant vibrations, without requiring a large amount of mass to do so. Because the localized insert 940 specifically contacts an area of dominant vibration, a large portion of the interior cavity 907 can be left empty without sacrificing sound or feel quality.

In many iron-type club heads, particularly hollow-body irons, dominant vibrations often occur near the top of the club head (i.e. near the top rail or upper portions of the face and/or rear portion). FIGS. 17-19 illustrate a club head 900 wherein the insert 940 is configured to damp vibrations occurring near the top rail 910 and/or the top of the strike face 902. In some embodiments, the localized insert 940 can be configured to damp vibrations occurring in other areas of the body 901 by contacting an interior surface of the sole 912, an interior surface of the top rail 910, an interior surface of the strike face 902, an interior surface of the rear wall 916, or any combination thereof.

Referring to FIG. 17, the club head 900 comprises a rear opening 930 located within the upper rear wall 922. In some embodiments, the rear opening 930 can form a substantial opening exposure area. In some embodiments, the upper rear opening can comprise an exposure area between 5 and 15 $cm^2$. In some embodiments, the upper rear opening can comprise an exposure area between 5 $cm^2$ and 7 $cm^2$, 7 $cm^2$ and 9 $cm^2$, 9 $cm^2$ and 11 $cm^2$, 11 $cm^2$ and 13 $cm^2$ or between 13 $cm^2$ and 15 $cm^2$. In some embodiments, the upper rear opening exposure area can be greater than 5 $cm^2$, 6 $cm^2$, 7 $cm^2$, 8 $cm^2$, 9 $cm^2$, 10 $cm^2$, 11 $cm^2$, 12 $cm^2$, 13 $cm^2$, or 14 $cm^2$. The inclusion of the rear opening 930 can contribute to an increase in discretionary mass of greater than 5 grams in comparison to a similar hollow-body iron devoid of a rear opening. Further, the rear opening 930 provides the club head 900 with a low CG height, because the rear opening 930 removes mass from the upper rear wall 922. In many embodiments, the club head 100 can comprise a CG ground height less than 0.75 inch, less than 0.65 inch, less than 0.55 inch, less than 0.45 inch, less than 0.35 inch, or less than 0.25 inch.

Referring to FIG. 18, the club head 900 comprises a badge 950 covering the rear opening 930. The badge 950 can be similar to one or more of the badges described above. The badge 950 can be formed of a substantially lightweight material, in order to preserve the discretionary mass created by the rear opening 930. Referring to FIG. 19, the upper rear wall 922 can define a recessed ledge 934 circumscribing the perimeter of the rear opening 930 and configured to receive the badge 950. The recessed ledge 934 can be inset from the outer surface of the rear wall 916. The badge 950 can be coupled to the recessed ledge 934, such that the badge 950 seals off the rear opening 930.

The club head 900 further comprises an insert 940 coupled to the badge 950 and partially occupying the interior cavity 907. As illustrated by FIGS. 18 and 19, the insert 940 can be sandwiched between the strike face rear surface 915 and the badge 950. In many embodiments, the insert 940 comprises an insert rear surface 944 coupled to a badge interior surface 953. In many embodiments, the insert 940 extends from the badge interior surface 953 to the strike face rear surface 915, extending through the interior cavity 907. In the illustrated embodiment, the insert 940 can comprise an abutment surface 942 configured to contact the strike face rear surface 915. The badge 950 and insert 940 can be positioned such that the abutment surface 942 contacts the strike face rear surface 915 at a strategic location to effectively damp vibrations.

To achieve desirable vibrational properties as well as desirable performance characteristics (i.e., ball speed, launch conditions, MOI, etc.) of the club head 900, the insert 940 can contact the strike face rear surface 915 in a way that damps vibrations without hindering the flexure of the strike face 902 (and thus reducing ball speed). The manner in which the insert 940 contacts the strike face 902 can be designed to damp vibrations without providing too much resistance against the strike face 902 as the strike face 902 flexes at impact. The contact surface area between the insert 940 and the strike face 902, the location of the contact between the insert 940 and the strike face 902, and the amount of pre-load force imposed on the strike face 902 by the insert 940 each affect both damping of vibrations as well as flexure of the strike face 902. For example, the larger the contact surface area between the insert 940 and the strike face 902, the greater the damping effect of the insert 940. However, a larger contact surface area between the insert 940 and the strike face 902 also increases resistive force against the strike face 902 at impact, hindering flexure. In some embodiments, the insert 940 increases damping effect while reducing contact surface area between the insert 940 and the strike face 902 and reducing pre-load force between the insert 940 and the strike face 902. Alternative embodiments of insert 940 configurations achieving balance between vibration damping and strike face flexure are described below.

In some embodiments, an abutment surface 942 of the insert 940 lightly rests against the strike face rear surface. In such embodiments, the insert can contact the strike face rear surface 915 without imposing any pre-load force on the strike face 902. In such embodiments, the contact between the insert 940 and the strike face 902 allows the insert 940 to damp unwanted vibrations without interfering with the flexure of the strike face 902. In alternative embodiments, the insert 940 can be compressed between the badge 950 and the strike face rear surface 915, such that the insert 940 provides a pre-load force against the strike face rear surface 915. In such embodiments, in addition to damping vibrations, the insert 940 can provide structural reinforcement to the strike face 902. In such embodiments, a substantial pre-load force can indirectly lead to increased flexure, because the structural support provided by the insert 940 allows the strike face 902 to be thinned and become more flexible.

Contact between the insert 940 and the strike face rear surface 915 can be characterized by contact surface area and contact location. The insert 940 defines a contact area measured as the surface area of the abutment surface 942 in contact with the strike face rear surface 915. In general, the contact area can be reduced while still providing the desired damping of vibrations. In some embodiments, the insert 940 comprises a contact area between 5 $cm^2$ and 7 $cm^2$, 7 $cm^2$ and 9 $cm^2$, or between 9 $cm^2$ and 12 $cm^2$. In some embodiments, the contact area can be greater than 5 $cm^2$, 6 $cm^2$, 7 $cm^2$, 8 $cm^2$, 9 $cm^2$, 10 $cm^2$, 11 $cm^2$, or greater than 12 $cm^2$.

Contact location (i.e. the location where the abutment surface 942 makes contact on the strike face rear surface 915) can be designed to provide efficient vibration damping. The contact location can be configured to correspond with the location of dominant vibrations experienced by the club head 900. By placing the abutment surface 942 at or near the location of said dominant vibrations, the insert 940 can provide an increased damping with reduced contact area.

As alluded to above, in many iron-type club heads, dominant vibrations occur in the top rail and/or at a top portion of the strike face. In some embodiments, the abutment surface 942 may only contact the strike face 902 at a location above the geometric center 920. In many embodiments, the entire abutment surface 942 can be located above the geometric center 920. The upward positioning of the abutment surface 942 targets the dominant vibrations near the top of the club head 900 and can provide a significant damping effect without requiring a large contact area. In other embodiments, the abutment surface 942 can contact other portions of the strike face 902, such as locations below the geometric center 920. Different club heads can have different dominant vibration locations, and the abutment surface 942 can be located accordingly.

As shown in FIG. 18, the contact location between the insert 940 and the strike face 900 can be substantially high on the strike face rear surface 915. In many embodiments, the entire contact surface area can be located above the geometric center 920 of the strike face 902. In other embodiments, between 80% and 100% of the contact surface area can be located above the geometric center 920 of the strike face 902. In some embodiments, between 80% and 85%, 85% and 90%, 90% and 95%, or between 95% and 100% of the contact surface area can be located above the geometric center 920 of the strike face 902.

Placing the insert 940 to correspond to the location of dominant vibrations can reduce the mass of the insert 920 necessary to provide the desired damping effect. The closer the insert 940 is located to dominant vibrations, the more efficient the damping effect, and therefore the less mass required to provide a desirable vibrational response. The lower the mass of the insert 940, the greater the amount of discretionary mass that can be redistributed throughout the club head 900. In many embodiments, the insert 940 can be made of an extremely lightweight foam material, such as a carbon foam. In many embodiments, the insert 940 comprises a mass between 0.5 gram and 10 grams. In many embodiments, the insert comprises a mass less than 10 grams, less than 9 grams, less than 8 grams, less than 7 grams, less than 6 grams, less than 5 grams, less than 4 grams, less than 3 grams, less than 2 grams, less than 1 gram, or less than 0.5 gram. Providing a low-mass insert 940 is particularly important in embodiments targeting dominant vibrations that occur high in the club head 900. Because the insert is located in an upper portion of the interior cavity 907, the low-mass insert 940 allows for a lower CG position, as compared to a higher-mass insert in the same location.

As shown in FIG. 18, the insert 940 only partially occupies the interior cavity 907. In many embodiments, the insert 940 can occupy between 5 and 30% of the interior cavity volume. In many embodiments, the remainder of the interior cavity 907 that is not occupied by the insert 940 can remain unfilled. In other embodiments, the remainder of the interior cavity 907 that is not occupied by the insert 940 can be fully or partially filled by a filler material, such as an injectable polymer material.

In some embodiments, the club head may comprise multiple rear openings, multiple badges covering said multiple rear openings, multiple inserts sandwiched between the badge and the strike face rear surface, or any combination thereof. In many embodiments, it may be advantageous to provide multiple inserts with abutment surfaces contacting strike face rear surface at different locations. Such embodiments can allow for more precise control over dominant vibrations occurring at specific locations.

J. Upper Rear Opening with Lattice Insert

Figure 20:
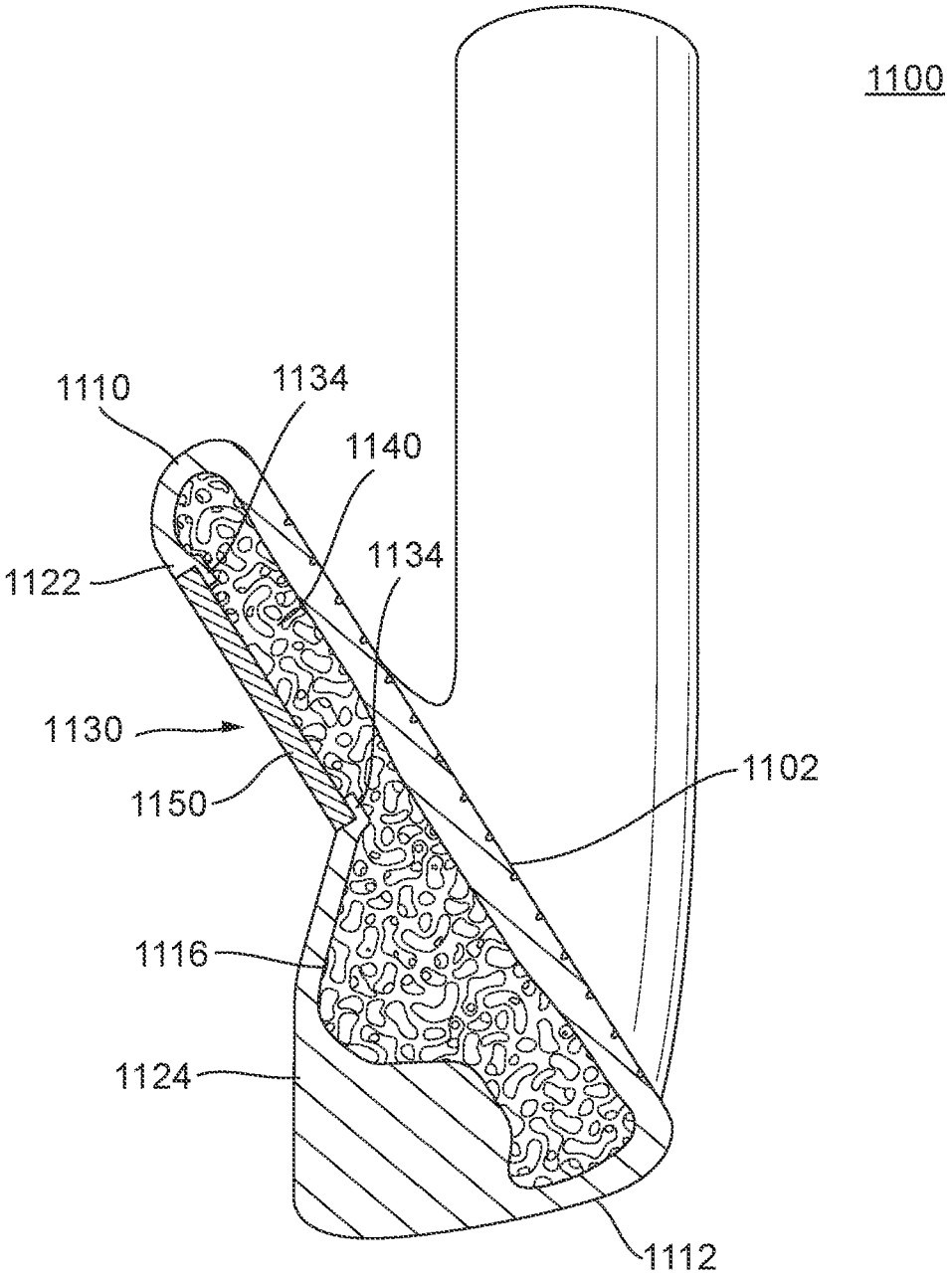
FIG. 20 illustrates a toe-side cross-sectional view of a golf club head comprising a rear opening, a badge, and an insert with a lattice structure.

FIG. 20 illustrates a club head 1100 comprising a rear opening 1130 and an insert 1140 comprising a lattice structure. The lattice insert 1140 has a plurality of internal and/or external spaces or voids, thereby reducing the mass of the lattice insert 1140 in comparison to a solid insert without such spaces or voids. The lattice insert 1140 partially occupies the interior cavity 1107 and creates a multi-material club head construction that is not solid. The lattice insert 1140 provides a high level of damping while creating more discretionary mass than a solidly constructed insert.

The lattice insert 1140 can comprise an insert profile defined by the peripheral most parts of the lattice insert 1140. While the lattice insert 1140 may comprise a profile that fills the entire interior cavity 1107, the lattice insert 1140 increases discretionary mass by providing an effective density that is lower than the insert material density. The lattice insert 1140 can fill a larger portion of the interior cavity volume without contributing a significant amount of mass to the club head 1100. The lattice insert 1140 can contact all the interior surfaces forming the interior cavity 1107, efficiently damping vibrations without contributing as much mass to the club head 1100 as a solid insert formed of the same material.

As discussed above, the lattice insert comprises an effective density that is lower than the insert material density. The effective density of the lattice insert 1140 is determined by comparing the insert material density with the proportion of the lattice insert profile that is occupied by the insert material. For example, if the lattice insert profile is only 50% occupied by insert material, the effective density of the lattice insert is 50% of the material density. In some embodiments, the effective density can be between 5% and 80% of the material density. In some embodiments, the effective density can be between 5% and 10%, between 10% and 15%, between 15% and 20%, between 20% and 25%, between 25% and 50%, between 50% and 75%, or between 60% and 80% of the material density.

In some embodiments, the effective density of the lattice insert 1140 can be between 0.0375 g/cm$^3$ and 1.5 g/cm$^3$. In some embodiments, the effective density of the lattice insert 1140 can be between 0.0375 and 0.250 g/cm$^3$, 0.250 and 0.500 g/cm$^3$, 0.500 and 0.750 g/cm$^3$, 0.750 and 1.000 g/cm$^3$, 1.000 and 1.250 g/cm$^3$, or between 1.250 and 1.500 g/cm$^3$. In some embodiments, the effective density of the lattice insert 1140 can be less than 1.500 g/cm$^3$, 1.450 g/cm$^3$, 1.400 g/cm$^3$, 1.350 g/cm$^3$, 1.300 g/cm$^3$, 1.250 g/cm$^3$, 1.200 g/cm$^3$, 1.150 g/cm$^3$, 1.100 g/cm$^3$, 1.050 g/cm$^3$, 1.00 g/cm$^3$, 0.950 g/cm$^3$, 0.900 g/cm$^3$, 0.850 g/cm$^3$, 0.800 g/cm$^3$, 0.750 g/cm$^3$, 0.700 g/cm$^3$, 0.650 g/cm$^3$, 0.600 g/cm$^3$, 0.550 g/cm$^3$, 0.500 g/cm$^3$, 0.450 g/cm$^3$, 0.400 g/cm$^3$, 0.350 g/cm$^3$, 0.300 g/cm$^3$, 0.250 g/cm$^3$, 0.200 g/cm$^3$, 0.150 g/cm$^3$, 0.100 g/cm$^3$, 0.050 g/cm$^3$, 0.040 g/cm$^3$, or less than 0.039 g/cm$^3$.

Referring to FIG. 20, the club head 1100 comprises a rear opening 1130 formed in the upper rear wall 1122. The rear opening 1130 can be substantially similar to rear opening 130 of club head 100, such that the rear opening 1130 extends across the entire rear wall 1116, in a heel-to-toe direction. In other embodiments, the rear opening 1130 can extend over only a portion of the upper rear wall 1122, similar to the heel-side upper opening 330 of club head 300.

As illustrated in FIG. 20, the rear opening 1130 is covered by a badge 1150, concealing the lattice insert 1140 within the interior cavity 1107. The badge 1150 not only protects the lattice insert 1140 from environmental damage, but also prevents debris from entering the interior cavity 1107 through the voids of the lattice insert 1140. Further, the badge 1150 allows the lattice insert 1140 to be formed from an insert material comprising a lower density and/or a lower hardness than would be required if the lattice insert 1140 was exposed through the rear opening 1130.

As shown in FIG. 20, the club head 1100 does not comprise an opening in the lower rear wall 1124. Similar to club head 100 described above, the club head 1100 provides a low CG height, because the rear opening 1130 removes mass from the upper rear wall 1122, while no mass is removed from the lower rear wall 1124. In some embodiments, the club head 100 can comprise a CG ground height less than 0.75 inch, less than 0.65 inch, less than 0.55 inch, less than 0.45 inch, less than 0.35 inch, or less than 0.25 inch.

Figure 21:
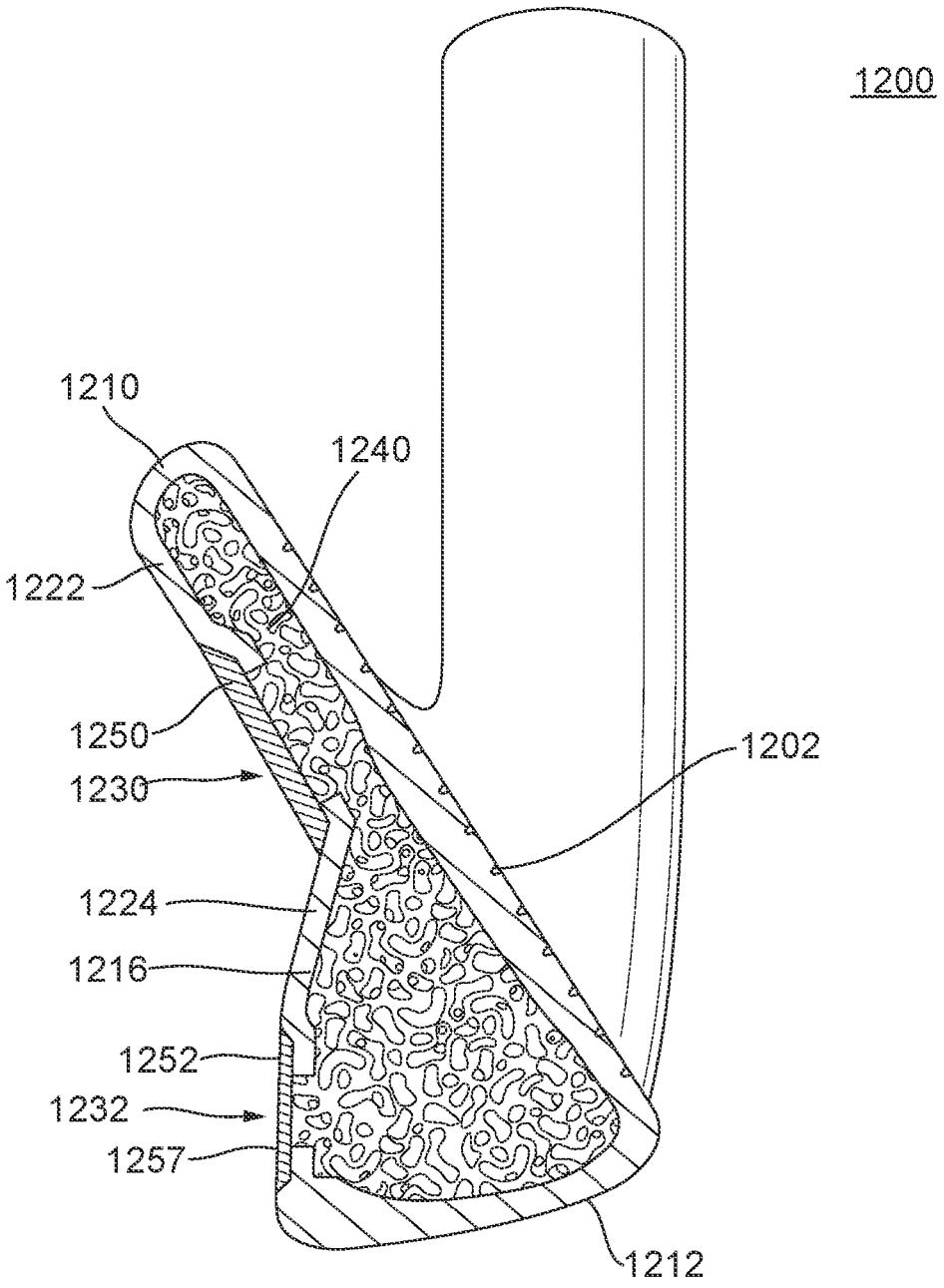
FIG. 21 illustrates a toe-side cross-sectional view of a golf club head comprising an upper rear opening, a lower rear opening, an upper badge, a lower badge, and an insert with a lattice structure.

Referring to FIG. 21, the club head 1200 can comprise multiple openings, such as an upper rear opening 1230 located in the upper rear wall 1222 and a lower rear opening 1232 located in the lower rear wall 1224. In such embodiments, the upper rear opening 1230 can be covered by an upper badge 1250, while the lower rear opening 1232 is covered by a second badge 1252. Providing multiple openings increases discretionary mass by removing a greater amount of mass from the rear wall 1216.

III. Additional Elements—Weights

In some embodiments, the body can further comprise one or more weights and/or one or more weight ports. Referring back to FIGS. 1 and 2, the club head 100 can comprise a toe weight 199 located in a lower portion of the toe 106. The club head body 101 can comprise a toe weight port housing the toe weight 199. In some embodiments, the toe weight port can be isolated from the interior cavity 107. In other embodiments, the toe weight port can comprise an opening into the interior cavity, to allow for injection of a filler material. In some embodiments, the golf club head can further comprise a tip weight configured to fit into the hosel 105.

Providing a toe weight 199 and/or a tip weight increases the perimeter weighting of the club head 100, raising one or more of the MOI values of the club head 100. In many embodiments, the discretionary mass provided by the insert can be redistributed into the tip weight and/or the toe weight. Because the tip weight and toe weight 199 are each located at the extreme heel and toe ends of the club head 100, increasing the mass of the tip weight and/or toe weight 199 provides a significant increase in Iyy.

It should be noted that while the toe weight 199 and tip weight are described and illustrated in reference to club head 100, a toe weight 199 and/or tip weight can be applied to any embodiment of the club head comprising a rear opening and an insert, including any of the club head embodiments described above and/or illustrated in the associated figures, such as club heads 100, 200, 300, 400, 500, 600, 700, 800, 900, 1000, 1100, and/or 1200. Further, although a toe weight and/or tip weight may be illustrated on one or more figures associated with one or more embodiments above, any of the embodiments described herein can be devoid of a toe weight, devoid of a tip weight, or both.

EXAMPLES

Example 1: Mass Savings Between Club Head with Rear Opening and Insert and Blade-Style Club Head A first example demonstrates the discretionary mass created by providing a club head with a rear opening and an insert fully occupying the interior cavity. When compared to a blade-style iron, the insert replaces high-density body material with low-density insert material. The amount of discretionary mass created can be calculated by multiplying the insert volume by the difference in densities between the body material and the insert material. In one embodiment, approximately 3 $cm^3$ of body material can be replaced by an insert. In one embodiment, the insert material density can be approximately 1.3 $g/cm^3$ and the body material density can be approximately 7.78 $g/cm^3$. As such, approximately 20 grams of discretionary mass are created by replacing body material with the insert. The redistribution of 20 grams of discretionary mass to the perimeter of the club head, can increase Iyy by between 7% and 12%. The multi-material solid construction of the exemplary club head provides a large amount of discretionary mass that can be used to provide a significant increase in forgiveness.

II. Example 2: Performance Comparison Between Club Head with Rear Opening and Insert and Blade-Style Club Head The performance characteristics were compared between a first exemplary club head according to the present invention and a first control club head. The first exemplary club head was similar to club head 100 described in detail above. The first exemplary club head comprised a body with an interior cavity and an insert fully occupying the interior cavity. The first exemplary club head further comprised a single rear opening in the upper rear wall, wherein the upper rear opening exposed the insert and provided an insert exposure area of 1.593 $in^2$ that covered 35% of the total rear wall surface area. The insert was formed of a TPU material with a hardness of Shore A80. The first exemplary club head will hereafter be referred to as the "TPU-insert club head."

The first control club head was a blade-style iron-type club head. The first control club head comprised a solidly-constructed body devoid of any inserts, openings, or voids. The first control club head was formed from a single material. The first control club head will hereafter be referred to as the "blade-style control club head."

An automated performance test used a golf swing apparatus to capture performance data of the club heads under regular conditions. The average carry distance was recorded and compared for each club head. Further, the performance test compared the accuracy of each club head by measuring and recording the dispersion area of the finishing positions of each shot in each club head's sample set. A smaller dispersion area represents a more accurate club head, as the finishing location of a given golf shot is more predictable for club heads with less dispersion. The results of the performance test are presented in Table 1 below.

TABLE 1

| | Blade-Style Control Club Head | TPU-insert Club Head | Difference | Percentage Increase |
|---|---|---|---|---|
| Carry Distance (yd) | 172.8 | 172.7 | −0.1 | −0.06% |
| Dispersion Area ($yd^2$) | 85 | 64 | −21 $yd^2$ | −24.7% |

The TPU-insert club head exhibited a significant decrease in dispersion area relative to the blade-style control club head. The dispersion area of the TPU-insert club head was 24.7% less than that of the blade-style control club head. The TPU-insert club head reduced dispersion while producing a similar carry distance to the first control club head (a negligible decrease of 0.06%).

The results of the performance test illustrate the improved performance of the TPU-insert club head over the blade-style control club head. The TPU-insert club head was significantly more accurate (and thereby more forgiving) than the blade-style control club head, while maintaining similar carry distance. The increased accuracy of the TPU-insert club head can be attributed to the increased discretionary mass created by replacing the high-density solid material within the body of the blade-style control club head with the lightweight insert of the TPU-insert club head.

III. Example 3: CG Comparison Between Club Heads with Rear Openings and Inserts and Hollow-Body Club Head The mass properties were compared between the TPU-insert club head, a second exemplary club head, and a second control club head. The second exemplary club head was identical to the TPU-insert club head described above in Example 2, but for the difference in insert material. The second exemplary club head comprised an insert formed of a TPE material and comprising a hardness of Shore A30. The second exemplary club head will hereafter be referred to as the "TPE-insert club head."

The second control club head was a hollow-body iron-type club head. The second control club head (hereafter the "hollow-body control club head") comprised a body with a continuous rear wall enclosing an interior cavity and devoid of any openings or inserts. Instead, the hollow-body control club head comprised 6 grams of an injectable filler material in the interior cavity, in accordance with the vibration damping methods of prior-art hollow-body irons.

The CG positions of each club head were measured and compared. Table 2 below presents the CG ground height and CG leading edge depth of each club head.

TABLE 2

| | Hollow-Body Control Club Head | TPU-Insert Club Head | TPE-Insert Club Head |
|---|---|---|---|
| CG Ground Height (in.) | 0.575 | 0.562 | 0.563 |
| CG Ground Height Difference Over Control (in.) | — | −0.013 | −0.012 |
| CG Leading Edge Depth (in.) | −0.539 | −0.526 | −0.527 |
| CG Leading Edge Depth Difference Over Control (in.) | — | +0.013 | +0.012 |

As illustrated in Table 2, the TPU-insert club head and TPE-insert club head each exhibited improvements in CG position. The exemplary club heads both comprised a CG location that was lower and more forward, relative to the hollow-body control club head. As discussed above, in iron-type club heads a lower and more forward CG position is desirable to promote increased launch characteristics. The improved CG position of the exemplary club heads is attributed to the inclusion of the upper rear opening in the rear wall. Providing a rear wall with an upper rear opening rather than a continuous rear wall removes mass from an upper and rearward portion of the club head, thereby creating discretionary mass that can be placed lower and more forward in the club head.

IV. Example 4: Performance Comparison Between Club Heads with Rear Openings and Inserts and Hollow-Body Club Head The performance characteristics were compared between the TPU-insert club head, the TPE insert club head, and the hollow-body control club head, each of which are described above in Examples 2 and 3. A player performance test was conducted to capture club head performance data under regular conditions. The test consisted of a plurality of golfers hitting a representative number of shots with each club head. The average carry distance was recorded and compared for each club head. Further, the performance test compared the accuracy of each club head by measuring and recording the dispersion area of the finishing positions of each shot in each club head's sample set. As described above, a smaller dispersion area represents a more accurate club head. The results of the first player performance test are presented in Table 3 below.

TABLE 3

| | Hollow-Body Control Club Head | TPU-Insert Club Head | TPE-Insert Club Head |
|---|---|---|---|
| Carry Distance (yd) | 174.0 | 174.4 | 174.5 |
| Carry Distance Difference Over Control (mph) | — | +0.4 | +0.5 |
| Carry Distance Percentage Increase Over Control | — | +0.22% | +0.29% |
| Dispersion Area ($yd^2$) | 918 | 559 | 836 |
| Dispersion Area Difference Over Control ($yd^2$) | — | 359 | 82 |
| Dispersion Area Percentage Increase Over Control | — | −39.1% | −8.9% |

The exemplary club heads each exhibited significant decreases in dispersion area and comparable carry distances (within 0.5 yards), relative to the hollow-body control club head. The dispersion area of the TPU-insert club head was 39.1% less than the hollow-body control club head, and the dispersion area of the TPE-insert club head was 8.9% less than the hollow-body control club head. The results of the player performance test illustrate the improved performance of the exemplary club heads over the hollow-body control club head. The exemplary club heads were significantly more accurate than the hollow-body control club head while providing comparable carry distances. The increased accuracy can be attributed to the fact that the exemplary club heads comprised a multi-material solid construction. The solid construction provides more consistent club head bending at impact, which produces more predictable ball flight characteristics.

V. Example 5: Comparison of Sound/Feedback Between Club Heads with Rear Openings and Inserts and Hollow-Body Club Head The sound and feel characteristics were compared between the TPU-insert club head, the TPC-insert club head, and the hollow-body control club head, each of which are described above in Examples 2 and 3. Referring back to the player performance test, participants were surveyed about the sound and feel of each club head. The participants were asked to rate their experience of each club head on a 1-5 scale regarding the following categories: 1) overall impact experience; 2) sound; and 3) overall club head satisfaction. A score of 5 represented the highest level of satisfaction, while a score of 1 represented the lowest level of satisfaction. The ratings were averaged and compared to determine if participants preferred the sound and feel of the exemplary club heads or the hollow-body control club head. The results of the survey regarding the TPU-insert club head, the TPE-insert club head, and the hollow-body control club head are presented below in Table 4.

TABLE 4

| | Hollow-Body Control Club Head | TPU-Insert Club Head | TPE-Insert Club Head |
|---|---|---|---|
| Impact Experience | 3.15 | 4.15 | 3.75 |
| Sound | 3.35 | 4.00 | 4.00 |
| Overall Satisfaction | 3.30 | 3.95 | 3.50 |

Participants preferred the sound and feel characteristics of the TPU-insert club head and the TPE-insert club head relative to the hollow-body control club head. The TPU-insert club head and the TPE-insert club head each scored higher than the hollow-body control club head in every category. Notably, participants rated the impact experience (which took into consideration both the sound and feel) of the exemplary club heads significantly higher than that of the hollow-body control club head. On average, participants rated the impact experience of the TPU-insert club head 27% higher than that of the hollow-body control club head. Similarly, participants rated the impact experience of the TPE-insert club head 17% higher than that of the hollow-body control club head.

The sound and feel improvements of the TPU-insert club head and the TPE-insert club head over the hollow-body control club head can be attributed to the insert. The TPU-insert club head and the TPE-insert club head comprised an insert that fully occupied the interior cavity. The insert provided high levels of vibration damping by contacting all surfaces forming the interior cavity, resulting in a more desirable sound and feel response at impact. In comparison, the hollow-body control club head comprised a localized deposit of injectable filler material in the interior cavity, rather than an insert. For the hollow-body control club head. The lack of an insert resulted in a lower degree of vibration damping.

VI. Example 6: Modal Frequency Analysis of Hollow-Body Iron with Rear Opening and Localized Insert The vibrational response between an exemplary club head (hereafter the "fourth exemplary club head") comprising a rear opening and a localized insert, according to the present embodiment, was compared to the vibrational response of a third control club head. The fourth exemplary club head comprised an upper rear opening with an exposure area of 1.565 $in^2$, a badge covering the upper rear opening, and a localized insert coupled to the badge. The localized insert only partially occupied the interior cavity and contacted an upper portion of the rear surface of the strike face. The fourth exemplary club head further comprised a contact surface area between the localized insert and the strike face of 1.263 $in^2$, and 93% of the contact surface area was located above the geometric center of the strike face. The third control club head was similar to the exemplary club head. The control club head comprised a similar rear opening and a badge covering the rear opening but was devoid of an insert. The interior cavity of the third control club head was left empty.

The third control club head exhibited a dominant frequency of 4638 Hz occurring on an upper portion of the strike face, while the fourth exemplary club head exhibited a dominant frequency of 7718 Hz at the same location. The dramatic increase in the dominant frequency between the third control club head and the fourth exemplary club head correlates to a more acoustically pleasing high-pitched sound at impact, rather than a low, dull sound at impact. The comparison illustrates that the inclusion of the localized insert contacting an upper portion of the strike face provided a significant improvement in the vibrational response of the exemplary club head.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

CLAUSES

Clause 1: A golf club head comprising: a body comprising a strike face comprising a geometric center, a sole, a top rail, a rear wall, a heel, a toe, and a hosel; the body at least partially enclosing an interior cavity; wherein the rear wall comprises a rear opening; wherein the rear opening fluidly communicates between a club head exterior and the interior cavity; an insert located within the interior cavity, wherein: the insert fully occupies the interior cavity; the insert and the body combine to form a multi-material solid construction without any voids or spaces therebetween; the insert comprises an insert exterior surface that is exposed to the club head exterior through the rear opening; the insert exterior surface forms at least a portion of a rear surface of the club head; the insert comprises an insert exposure area defined as the surface area of the insert exterior surface that is exposed to the club head exterior; the insert exposure area is between 1.3 $in^2$ and 1.9 $in^2$; wherein the rear wall defines a rear wall surface area; and wherein the insert exposure area is between 20% and 50% of the rear wall surface area.

Clause 2: The golf club head of clause 1: wherein the insert comprises an insert density less than 2.0 $g/cm^3$.

Clause 3: The golf club head of clause 1: wherein the insert comprises a volume greater than 10 $cm^3$.

Clause 4: The golf club head of clause 2, wherein: the body comprises a body density; the club head comprises an insert density ratio defined as the insert density divided by the body density; and the insert density ratio is less than 0.25.

Clause 5: The golf club head of clause 1, wherein the insert exterior surface is flush with the rear wall.

Clause 6: The golf club head of claim 1, wherein the insert creates more than 15 grams of discretionary mass over a similarly shaped club head comprising a single-material solid construction.

Clause 7: A golf club head comprising: a body comprising a strike face comprising a geometric center, a sole, a top rail, a rear wall, a heel, a toe, and a hosel; the body at least partially enclosing an interior cavity; wherein the rear wall comprises a rear opening; wherein the rear opening fluidly communicates between a club head exterior and the interior cavity; an insert located within the interior cavity, wherein: the insert fully occupies the interior cavity; the insert and the body combine to form a multi-material solid construction without any voids or spaces therebetween; the insert comprises an insert exterior surface that is exposed to the club head exterior through the rear opening; the insert exterior surface forms at least a portion of a rear surface of the club head; the insert comprises an insert exposure area defined as the surface area of the insert exterior surface that is exposed to the club head exterior; the insert exposure area is between 1.3 $in^2$ and 1.9 $in^2$; wherein the rear wall defines a rear wall surface area; wherein the insert exposure area is between 20% and 50% of the rear wall surface area; wherein the insert has a uniform hardness; and wherein the uniform hardness of the insert is greater than Shore A60.

Clause 8: The golf club head of clause 7, wherein the insert comprises an insert density less than 2.0 g/cm$^3$.

Clause 9: The golf club head of clause 8, wherein: the body comprises a body density; the club head comprises an insert density ratio defined as the insert density divided by the body density; and the insert density ratio is less than 0.25.

Clause 10: The golf club head of clause 7, wherein the insert comprises a volume greater than 10 cm$^3$.

Clause 11: The golf club head of clause 7, wherein the insert creates more than 15 grams of discretionary mass over a similarly shaped club head comprising a single-material solid construction.

Clause 12: A golf club head comprising: the body comprising a strike face comprising a geometric center, a sole, a top rail, a rear wall, a heel end, a toe end, and a hosel; the body at least partially enclosing an interior cavity; wherein the rear wall comprises an upper rear opening; wherein the upper rear opening fluidly communicates between a club head exterior and the interior cavity; wherein the rear wall comprises an inflection seam extending approximately horizontally from the heel end to the toe end; wherein the rear wall comprises a rear wall upper portion extending from the inflection seam to the top rail and a rear wall lower portion extending from the inflection seam to the sole; wherein the upper rear opening is located within the rear wall upper portion; the upper rear opening comprising an upper rear opening exposure area between 1.3 in$^2$ and 1.9 in$^2$; an insert located within the interior cavity, wherein: the insert fully occupies the interior cavity; the insert and the body combine to form a multi-material solid construction without any voids or spaces therebetween; the insert comprises an upper insert exterior surface that is exposed to the club head exterior through the upper rear opening; and the upper insert exterior surface forms at least a portion of a rear surface of the club head.

Clause 13: The golf club head of clause 12, wherein the insert comprises an insert density less than 2.0 g/cm$^3$.

Clause 14: The golf club head of clause 12, wherein the insert comprises a volume greater than 10 cm$^3$.

Clause 15: The golf club head of clause 13, wherein: the body comprises a body density; the club head comprises an insert density ratio defined as the insert density divided by the body density; and the insert density ratio is less than 0.25.

Clause 16: The golf club head of clause 12, further comprising a lower rear opening located within the rear wall lower portion; wherein the lower rear opening comprises a lower rear opening exposure area between 1.3 in$^2$ and 1.9 in$^2$.

Clause 17: The golf club head of clause 16, wherein the upper rear opening and the lower rear opening comprise a combined opening exposure area between 2.0 in$^2$ and 4.0 in$^2$.

Clause 18: The golf club head of clause 16, wherein the insert comprises a lower insert exterior surface that is exposed to the club head exterior through the lower rear opening; and wherein the lower insert exterior surface forms at least a portion of the rear surface of the club head.

Clause 19: The golf club head of clause 12, wherein the insert comprises a volume greater than 10 cm$^3$.

Clause 20: The golf club head of clause 12, wherein the insert creates more than 15 grams of discretionary mass over a similarly shaped club head comprising a single-material solid construction.

Clause 21: A golf club head comprising: a body comprising a strike face comprising a geometric center and a strike face rear surface a sole, a top rail, a rear wall, a heel, a toe, and a hosel; the body at least partially enclosing an interior cavity; wherein the rear wall comprises a rear opening; wherein the rear opening fluidly communicates between a club head exterior and the interior cavity; wherein the rear wall comprises a recessed ledge circumscribing the rear opening; a badge; an insert partially occupying the interior cavity wherein a perimeter of the badge is coupled to the recessed ledge such that the badge at least partially closes the rear opening; the badge comprising a badge interior surface disposed to the interior cavity and a badge exterior surface opposite the badge interior surface and disposed to the club head exterior; the insert comprises an insert abutment surface abutting the strike face rear surface and an insert rear surface coupled to the badge interior surface; wherein the insert abutment surface is entirely located above the geometric center of the strike face.

The invention claimed is:

1. A golf club head comprising:

a body comprising a strike face comprising a geometric center, a sole, a top rail, a rear wall, a heel, a toe, and a hosel;

the body at least partially enclosing an interior cavity;

wherein the rear wall comprises an upper rear opening and a lower rear opening located within a rear wall lower portion;

wherein the upper rear opening fluidly communicates between a club head exterior and the interior cavity and the lower rear opening comprises a lower rear opening exposure area between 1.3 in$^2$ and 1.9 in$^2$;

an insert located within the interior cavity, wherein:

the insert fully occupies the interior cavity;

the insert and the body combine to form a multi-material solid construction without any voids or spaces therebetween;

the insert comprises an upper insert exterior surface that is exposed to the club head exterior through the upper rear opening;

the upper insert exterior surface forms at least a portion of a rear surface of the golf club head;

the insert comprises an insert exposure area defined as a surface area of the upper insert exterior surface that is exposed to the club head exterior;

the insert exposure area is between 1.3 in$^2$ and 1.9 in$^2$;

wherein the rear wall defines a rear wall surface area; and wherein the insert exposure area is between 20% and 50% of the rear wall surface area.

2. The golf club head of claim 1, wherein the insert comprises an insert density less than 2.0 g/cm$^3$.

3. The golf club head of claim 1, wherein the insert comprises a volume greater than 10 cm$^3$.

4. The golf club head of claim 2, wherein:

the body comprises a body density;

the club head comprises an insert density ratio defined as the insert density divided by the body density; and the insert density ratio is less than 0.25.

5. The golf club head of claim 1, wherein the upper insert exterior surface is flush with the rear wall.

6. The golf club head of claim 1, wherein the upper rear opening and the lower rear opening comprise a combined opening exposure area between 2.0 $in^2$ and 4.0 $in^2$.

7. The golf club head of claim 1, wherein the insert comprises a lower insert exterior surface that is exposed to the club head exterior through the lower rear opening; and wherein the lower insert exterior surface forms at least a portion of the rear surface of the club head.

8. A golf club head comprising:

a body comprising a strike face comprising a geometric center, a sole, a top rail, a rear wall, a heel, a toe, and a hosel;

the body at least partially enclosing an interior cavity;

wherein the rear wall comprises an upper rear opening and a lower rear opening located within a rear wall lower portion;

wherein the upper rear opening fluidly communicates between a club head exterior and the interior cavity and the lower rear opening comprises a lower rear opening exposure area between 1.3 $in^2$ and 1.9 $in^2$;

an insert located within the interior cavity, wherein:

the insert fully occupies the interior cavity;

the insert and the body combine to form a multi-material solid construction without any voids or spaces therebetween;

the insert comprises an upper insert exterior surface that is exposed to the club head exterior through the upper rear opening;

the upper insert exterior surface forms at least a portion of a rear surface of the golf club head;

the insert comprises an insert exposure area defined as a surface area of the upper insert exterior surface that is exposed to the club head exterior;

the insert exposure area is between 1.3 $in^2$ and 1.9 $in^2$;

wherein the rear wall defines a rear wall surface area;

wherein the insert exposure area is between 20% and 50% of the rear wall surface area;

wherein the insert has a uniform hardness; and wherein the uniform hardness of the insert is greater than Shore A60.

9. The golf club head of claim 8, wherein the insert comprises an insert density less than 2.0 $g/cm^3$.

10. The golf club head of claim 9, wherein:

the body comprises a body density;

the club head comprises an insert density ratio defined as the insert density divided by the body density; and the insert density ratio is less than 0.25.

11. The golf club head of claim 8, wherein the insert comprises a volume greater than 10 $cm^3$.

12. The golf club head of claim 8, wherein the upper rear opening and the lower rear opening comprise a combined opening exposure area between 2.0 $in^2$ and 4.0 $in^2$.

13. The golf club head of claim 8, wherein the insert comprises a lower insert exterior surface that is exposed to the club head exterior through the lower rear opening; and wherein the lower insert exterior surface forms at least a portion of the rear surface of the club head.

14. A golf club head comprising:

a body comprising a strike face comprising a geometric center, a sole, a top rail, a rear wall, a heel end, a toe end, and a hosel;

the body at least partially enclosing an interior cavity;

wherein the rear wall comprises an upper rear opening and a lower rear opening located within a rear wall lower portion;

wherein the upper rear opening fluidly communicates between a club head exterior and the interior cavity and the lower rear opening comprises a lower rear opening exposure area between 1.3 $in^2$ and 1.9 $in^2$;

wherein the rear wall comprises an inflection seam extending approximately horizontally from the heel end to the toe end;

wherein the rear wall comprises a rear wall upper portion extending from the inflection seam to the top rail and a rear wall lower portion extending from the inflection seam to the sole;

wherein the upper rear opening is located within the rear wall upper portion;

the upper rear opening comprising an upper rear opening exposure area between 1.3 $in^2$ and 1.9 $in^2$;

an insert located within the interior cavity, wherein:

the insert fully occupies the interior cavity;

the insert and the body combine to form a multi-material solid construction without any voids or spaces therebetween;

the insert comprises an upper insert exterior surface that is exposed to the club head exterior through the upper rear opening; and the upper insert exterior surface forms at least a portion of a rear surface of the golf club head.

15. The golf club head of claim 14, wherein the insert comprises an insert density less than 2.0 $g/cm^3$.

16. The golf club head of claim 14, wherein the insert comprises a volume greater than 10 $cm^3$.

17. The golf club head of claim 15, wherein:

the body comprises a body density;

the club head comprises an insert density ratio defined as the insert density divided by the body density; and the insert density ratio is less than 0.25.

18. The golf club head of claim 14, wherein the upper rear opening and the lower rear opening comprise a combined opening exposure area between 2.0 $in^2$ and 4.0 $in^2$.

19. The golf club head of claim 14, wherein the insert comprises a lower insert exterior surface that is exposed to the club head exterior through the lower rear opening; and wherein the lower insert exterior surface forms at least a portion of the rear surface of the club head.

* * * * *